US009847049B2

(12) United States Patent
Zhang et al.

(10) Patent No.: US 9,847,049 B2
(45) Date of Patent: Dec. 19, 2017

(54) MULTIPATH SELECTION CIRCUIT AND DISPLAY DEVICE

(71) Applicants: Xiamen Tianma Micro-Electronics Co., Ltd., Xiamen (CN); Tianma Micro-Electronics Co., Ltd., Shenzhen (CN)

(72) Inventors: Lei Zhang, Xiamen (CN); Hanyu Gu, Xiamen (CN); Liu Wang, Xiamen (CN)

(73) Assignees: XIAMEN TIANMA MICRO-ELECTRONICS CO., LTD., Xiamen (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 210 days.

(21) Appl. No.: 14/942,942

(22) Filed: Nov. 16, 2015

(65) Prior Publication Data

US 2016/0180795 A1 Jun. 23, 2016

(30) Foreign Application Priority Data

Dec. 23, 2014 (CN) ..... 2014 1 0809263

(51) Int. Cl.
*G09G 5/00* (2006.01)
*G09G 3/20* (2006.01)

(52) U.S. Cl.
CPC ..... *G09G 3/20* (2013.01); *G09G 2310/0297* (2013.01)

(58) Field of Classification Search
None
See application file for complete search history.

(56) References Cited

U.S. PATENT DOCUMENTS

2003/0117360 A1 6/2003 Bu
2003/0234761 A1* 12/2003 Washio ..... G09G 3/3688 345/100
2006/0181502 A1* 8/2006 Kubota ..... G09G 3/3677 345/100

(Continued)

FOREIGN PATENT DOCUMENTS

CN 1467699 A 1/2004
CN 103208261 A 7/2013

(Continued)

*Primary Examiner* — Carolyn R Edwards
*Assistant Examiner* — Krishna Neupane
(74) *Attorney, Agent, or Firm* — Faegre Baker Daniels LLP

(57) ABSTRACT

A multipath selection circuit includes a first data line, a second data line, a third data line, a control line, a timing line, a switch circuit, and a drive circuit. The drive circuit includes a first switching transistor and a second switching transistor. The switch circuit is configured to receive a control signal, timing signal, first data signal, second data signal and third data signal, and operate in a first operating mode or a second operating mode according to the control signal and the timing signal. In the first operating mode, the switch circuit is configured to transmit the second data signal to the first switching transistor and the second switching transistor in a time division manner; and in the second operating mode, the switch circuit is configured to transmit the first data signal to the first switching transistor and the third data signal to the second switching transistor.

19 Claims, 9 Drawing Sheets

(56) References Cited

U.S. PATENT DOCUMENTS

2008/0136810 A1* 6/2008 Itakura ..... G09G 3/2011
345/215

FOREIGN PATENT DOCUMENTS

| | | | |
|---|---|---|---|
| CN | 103714777 | A | 4/2014 |
| JP | 2001056664 | A | 2/2001 |
| TW | 531729 | B | 5/2003 |

* cited by examiner

MULTIPATH SELECTION CIRCUIT AND DISPLAY DEVICE

CROSS-REFERENCE TO RELATED APPLICATION

This application claims priority to Chinese Application No. 201410809263.7, filed Dec. 23, 2014, which is herein incorporated by reference in its entirety.

TECHNICAL FIELD

The present disclosure relates to the field of display technologies and, in particular, to a multipath selection circuit and a display device.

BACKGROUND

A multipath selector (also referred to as a "demux") in the existing display panel is mainly characterized by, according to a ratio of the number of integrated circuits (ICs) to the number of data lines, a 1:2 operating mode in which a signal from each of the ICs controls two columns of pixels and a 1:3 operating mode in which a signal from each of the ICs controls three columns of pixels.

However, there is a need to improve performances of the multipath selector in the existing display panel.

SUMMARY

The present disclosure provides a multipath selection circuit and a display device, to solve technical problems in the related art.

The disclosure provides a multipath selection circuit, including: a first data line for transmitting a first data signal, a second data line for transmitting a second data signal, a third data line for transmitting a third data signal, a control line for transmitting a control signal, a timing line for transmitting a timing signal, a switch circuit and a drive circuit, the drive circuit comprises at least a first switching transistor and a second switching transistor;

the switch circuit is configured to receive the control signal, the timing signal, the first data signal, the second data signal and the third data signal, and operate in a first operating mode or a second operating mode according to the control signal and the timing signal;

wherein in the first operating mode, the switch circuit is configured to transmit the second data signal to the first switching transistor and the second switching transistor in a time division manner; and in the second operating mode, the switch circuit is configured to transmit the first data signal to the first switching transistor and transmit the third data signal to the second switching transistor.

The disclosure further provides a multipath selection circuit, including a first switch and a second switch, wherein, the first switch comprises a first sub-switch, a second sub-switch, a third sub-switch, and a fourth sub-switch, and the second switch comprises a fifth sub-switch, a sixth sub-switch, a seventh sub-switch and an eighth sub-switch;

the multipath selection circuit further comprises a first switching transistor, a second switching transistor, a first data line for transmitting a first data signal, a second data line for transmitting a second data signal, a third data line for transmitting a third data signal, a first timing line for transmitting a first timing signal, a second timing line for transmitting a second timing signal and a third timing line for transmitting a third timing signal;

a source electrode of the first switching transistor is configured to receive the second data signal via the first sub-switch and receive the first data signal via the fifth sub-switch, and a gate electrode of the first switching transistor is configured to receive the first timing signal via the second sub-switch and receive the third timing signal via the sixth sub-switch;

a source electrode of the second switching transistor is configured to receive the second data signal via the third sub-switch and receive the third data signal via the seventh sub-switch, and a gate electrode of the second switching transistor is configured to receive the second timing signal via the fourth sub-switch and receive the third timing signal via the eighth sub-switch; and the four sub-switches of the first switch are configured to be turned on or turned off simultaneously, and the four sub-switches of the second switch are configured to be turned on or turned off simultaneously; when the first switch is turned on, the second switch is turned off, and when the first switch is turned off, the second switch is turned on.

The disclosure further provides a display device, including the above gate controlling circuit and six pixels;

wherein, the six pixels comprise: a first pixel connected with a drain electrode of the first switching transistor, a second pixel connected with a drain electrode of the second switching transistor, a third pixel connected with a drain electrode of the third switching transistor, a fourth pixel connected with a drain electrode of the fourth switching transistor, a fifth pixel connected with a drain electrode of the fifth switching transistor, and a sixth pixel connected with a drain electrode of the sixth switching transistor.

With the switch circuit provided by the present disclosure, where the switch circuit can operate in the first operating mode and the second operating mode and can be switched between the first operating mode and the second operating mode, the multipath selection circuit including the switch circuit can operate in the 1:3 operating mode and the 1:2 operating mode, and can further arbitrarily switch between the 1:3 operating mode and the 1:2 operating mode. Accordingly, the display device including the multipath selection circuit can be adapted for two operating modes so as to improve adaptability of the display device with respect to the data signals.

While multiple embodiments are disclosed, still other embodiments of the disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

In order to more clearly illustrate technical solutions of embodiments of the disclosure or the prior art, the accompanying drawings used for the description of the embodiments or the prior art are briefly introduced below. Obviously, the drawings for the following description only show some embodiments of the disclosure, and other drawings may also be obtained from the described drawings.

Figure 1A:
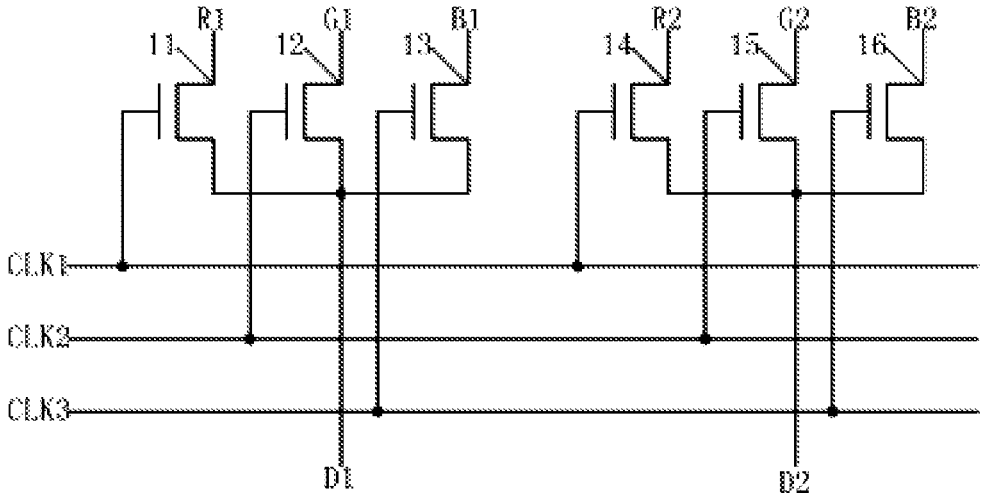
FIG. 1A is a schematic diagram of a display panel in a 1:3 operating mode provided in the related art.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

In order to make objects, technical solutions and advantages of the present disclosure more clear, the technical solutions of the disclosure are described below by embodiments in combination with the drawings. Obviously, the described embodiments are some instead of all embodiments of the disclosure. All other embodiments obtained in light of the described embodiments of the disclosure fall within the protection scope of the disclosure.

Figure 1B:
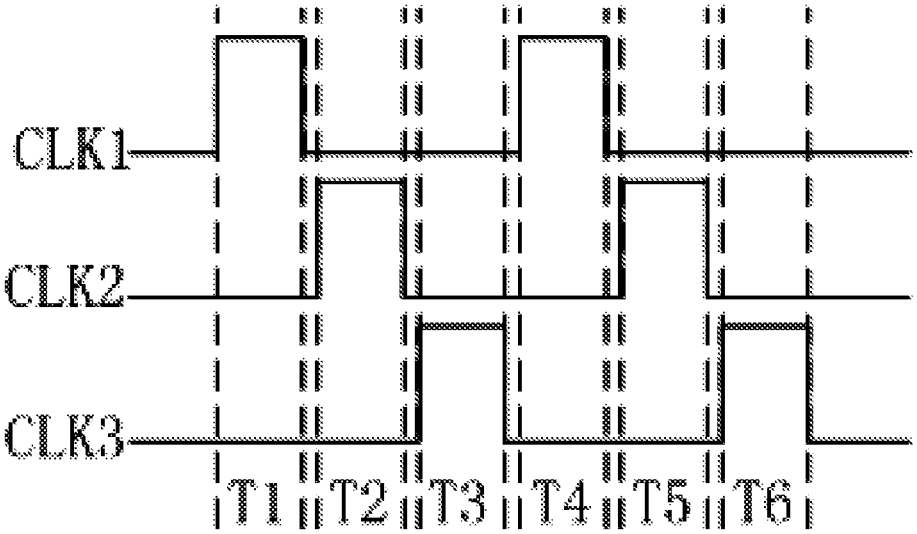
FIG. 1B is a timing diagram of a display panel in a 1:3 operating mode provided in the related art.

FIG. 1A is a schematic diagram of a display panel in a 1:3 operating mode provided in the related art. As shown in FIG. 1A, the display panel includes: data lines D1 and D2, timing lines CLK1, CLK2 and CLK3, a switching transistor 11, a switching transistor 12, a switching transistor 13, a switching transistor 14, a switching transistor 15 and a switching transistor 16, columns of sub-pixels R1, G1, B1, R2, G2 and B2, where, a drain electrode (D) of the switching transistor 11, a drain electrode (D) of the switching transistor 12 and a drain electrode (D) of the switching transistor 13 are connected with the columns of sub-pixels R1, G1 and B1, respectively; a gate electrode (G) of the switching transistor 11, a gate electrode (G) of the switching transistor 12 and a gate electrode (G) of the switching transistor 13 are connected with the timing lines CLK1, CLK2 and CLK3, respectively; and a source electrode (S) of the switching transistor 11, a source electrode (S) of the switching transistor 12 and a source electrode (S) of the switching transistor 13 are all connected with the date line D1; a drain electrode of the switching transistor 14, a drain electrode of the switching transistor 15 and a drain electrode of the switching transistor 16 are connected with the columns of sub-pixels R2, G2 and B2, respectively; a gate electrode of the switching transistor 14, a gate electrode of the switching transistor 15 and a gate electrode of the switching transistor 16 are connected with the timing lines CLK1, CLK2 and CLK3, respectively; and a source electrode of the switching transistor 14, a source electrode of the switching transistor 15 and a source electrode of the switching transistor 16 are all connected with the date line D2. Reference is made below to FIG. 1B which is a timing diagram of a display panel in a 1:3 operating mode provided in the related art. By combining FIG. 1A and FIG. 1B, in a clock cycle including time periods T1 to T6, a high level is applied to the timing line CKL1 during the time period T1 to turn on the switching transistor 11, so that the data line D1 transmits a data signal to the column of sub-pixels R1 to enable display by the column of sub-pixels R1; then the column of sub-pixels G1 receives a data signal from the data line D1 during the time period T2; the column of sub-pixels B1 receives a data signal from the data line D1 during the time period T3; the column of sub-pixels R2 receives a data signal from the data line D2 during the time period T4; the column of sub-pixels G2 receives a data signal from the data line D2 during the time period T5; and the column of sub-pixels B2 receives a data signal from the data line D2 during the time period T6. Here, two different IC signals are transmitted on the data lines D1 and D2, respectively, and each of the two IC signals in the display panel can control three columns of sub-pixels, and thus the operating mode is a 1:3 operating mode.

Figure 1C:
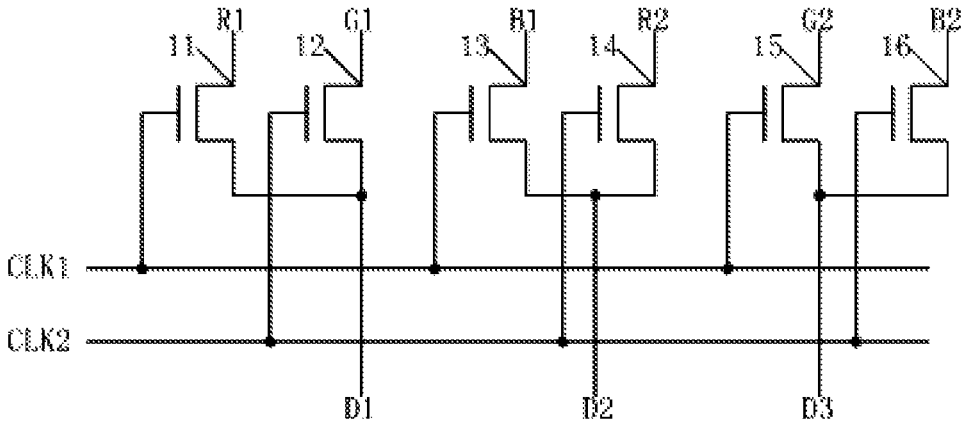
FIG. 1C is a schematic diagram of a display panel in a 1:2 operating mode provided in the related art.
Figure 1D:
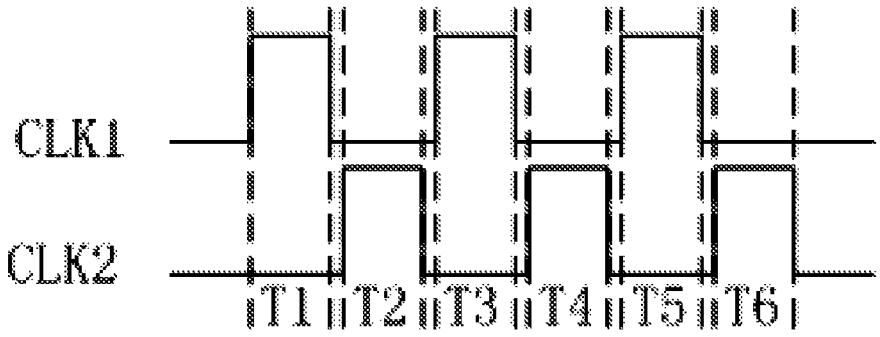
FIG. 1D is a timing diagram of a display panel in a 1:2 operating mode provided in the related art.

FIG. 1C is a schematic diagram of a display panel in a 1:2 operating mode provided in the related art. As shown in FIG. 1C, the display panel includes: data lines D1, D2, and D3, timing lines CLK1 and CLK2, a switching transistor 11, a switching transistor 12, a switching transistor 13, a switching transistor 14, a switching transistor 15 and a switching transistor 16, columns of sub-pixels R1, G1, B1, R2, G2 and B2, where, a drain electrode (D) of the switching transistor 11 and a drain electrode (D) of the switching transistor 12 are connected sequentially with the columns of sub-pixels R1 and G1, a gate electrode (G) of the switching transistor 11 and a gate electrode (G) of the switching transistor 12 are connected sequentially with the timing lines CLK1 and CLK2, respectively, and a source electrode (S) of the switching transistor 11 and a source electrode (S) of the switching transistor 12 are both connected with the date line D1; a drain electrode of the switching transistor 13 and a drain electrode of the switching transistor 14 are connected sequentially with the columns of sub-pixels B1 and R2, a gate electrode of the switching transistor 13 and a gate electrode of the switching transistor 14 are connected sequentially with the timing lines CLK1 and CLK2, respectively, and a source electrode of the switching transistor 13 and a source electrode of the switching transistor 14 are both connected with the date line D2; a drain electrode of the switching transistor 15 and a drain electrode of the switching transistor 16 are connected sequentially with the columns of sub-pixels G2 and B2, a gate electrode of the switching transistor 15 and a gate electrode of the switching transistor 16 are connected sequentially with the timing lines CLK1 and CLK2, respectively, and a source electrode of the switching transistor 15 and a source electrode of the switching transistor 16 are both connected with the date line D3. Reference is made below to FIG. 1D which is a timing diagram of a display panel in a 1:2 operating mode provided in the related art. By combining FIG. 1C and FIG. 1D, in a clock cycle including time periods T1 to T6, a high level is applied to the timing line CKL1 during the time period T1 to turn on the switching transistor 11, so that the data line transmits a data signal to the column of sub-pixels R1 to enable display by the column of sub-pixels R1; then the column of sub-pixels G1 receives a data signal from the data line D1 during the time period T2; the column of sub-pixels B1 receives a data signal from the data line D2 during the time period T3; the column of sub-pixels R2 receives a data signal from the data line D2 during the time period T4; the column of sub-pixels G2 receives a data signal from the data line D3 during the time period T5; the column of sub-pixels B2 receives a data signal from the data line D3 during the time period T6. Here, it should be understood that three different IC signals are transmitted on the data lines D1, D2 and D3 respectively, thereby it can be known from the above that an IC signal in the display panel can control two columns of sub-pixels, and thus the operating mode is a 1:2 operating mode.

Figure 2A:
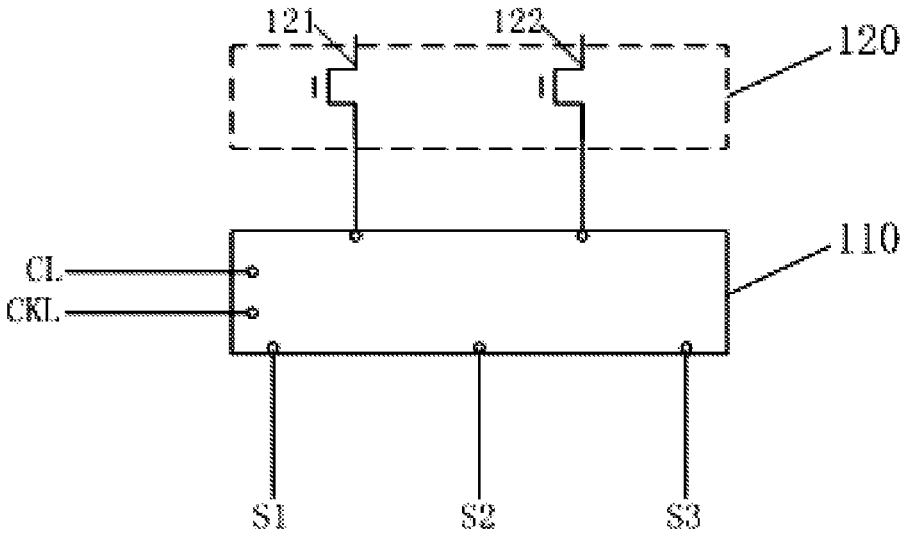
FIG. 2A is a schematic diagram of a multipath selection circuit, according to embodiments of the disclosure.

FIG. 2A is a schematic diagram of a multipath selection circuit, according to embodiments of the disclosure. By using technical solutions of the disclosure, the display device can operate in a 1:3 operating mode or in a 1:2 operating mode, and can switch between the 1:3 operating mode and the 1:2 operating mode through control.

Embodiments of the disclosure provide a multipath selection circuit, including: a first data line S1 for transmitting a first data signal, a second data line S2 for transmitting a second data signal, a third data line S3 for transmitting a third data signal, a control line CL for transmitting a control signal, a timing line CKL for transmitting a timing signal, a switch circuit 110 and a drive circuit 120, where, the drive circuit includes at least a first switching transistor 121 and a second switching transistor 122.

As shown in FIG. 2A, data inputting terminals of the switch circuit 110 are connected with the first data line S1, the second data line S2 and the third data line S3, respectively; control terminals of the switch circuit 110 are connected with the control line CL and the timing line CKL, respectively; and data outputting terminals of the switch circuit 110 are connected with the first switching transistor 121 and the second switching transistor 122, respectively. Therefore, the switch circuit 110 is configured to receive a control signal, a timing signal, a first data signal, a second data signal and a third data signal. The control signal and the timing signal control the switch circuit 110 to be turned on or off, so that the switch circuit 110 can selectively transmit data signal(s) to the first switching transistor 121 and the second switching transistor 122, respectively. In such case, the switch circuit 110 can include two operating modes according to different data signals outputted by the switch circuit 110.

Here, in a first operating mode of the switch circuit 110, the switch circuit 110 is configured to transmit the second data signal to the first switching transistor 121 and the second switching transistor 122 in a time division manner, i.e. the second data line S2 controls the first switching transistor 121 and the second switching transistor 122 in a time division manner; and in a second operating mode of the switch circuit 110, the switch circuit 110 is configured to transmit the first data signal to the first switching transistor 121 and transmit the third data signal to the second switching transistor 122, i.e. the first data line S1 and the third data line S3 control the first switching transistor 121 and the second switching transistor 122, respectively. As can be seen from the above, the switch circuit 110 alternatively operates in the first operating mode and the second operating mode according to the control signal and the timing signal; in the first operating mode, the switch circuit 110 transmits the second data signal to the first switching transistor 121 and the second switching transistor 122 in a time division manner; and in the second operating mode, the switch circuit 110 transmits the first data signal to the first switching transistor 121 and transmits the third data signal to the second switching transistor 122.

As above, in the multipath selection circuit, the switch circuit 110 selects and transmits one or two of the three data signals to the first switching transistor 121 and the second switching transistor 122 based on the control signal and the timing signal, so that the multipath selection circuit can switch the operating modes thereof according to a data switching function of the switch circuit 110.

Figure 2B:
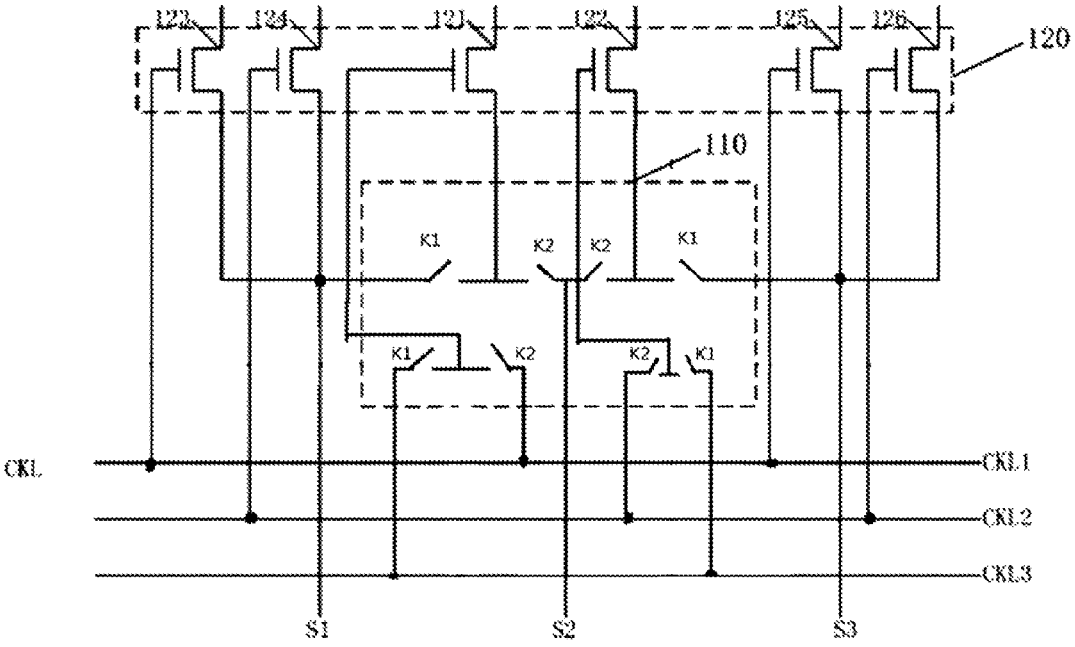
FIG. 2B is a schematic diagram of another multipath selection circuit, according to embodiments of the disclosure.

FIG. 2B is a schematic diagram of another multipath selection circuit, according to embodiments of the disclosure. The switch circuit 110 has the two operating modes which can be arbitrarily switched. As such, for each of the two operating modes, the switch circuit 110 has a separate switch configured to control the operating mode independently. As shown in FIG. 2B, the switch circuit includes: a first switch K1 and a second switch K2, where, the first switch K1 controls the switch circuit 110 to operate in the first operating mode, and the second switch K2 controls the switch circuit 110 to operate in the second operating mode. Since the switch circuit 110 cannot operate in both the first operating mode and second operating mode concurrently, the control signal received by the switch circuit 110 selectively enables the first switch K1 to be turned on or enable the second switch K2 to be turned on, but not both the first switch K1 and the second switch K2 to be turned on simultaneously.

When the control signal is received by the switch circuit 110 to turn on the first switch K1, the switch circuit 110 transmits the second data signal from the second data signal line S2 to the first switching transistor 121 and the second switching transistor 122 via the first switch K1 in a time division manner under the control of the timing signal; and when the control signal is received by the switch circuit 110 to turn on the second switch K2, the switch circuit 110 transmits the first data signal from the first data line S1 to the first switching transistor 121 and transmits the third data signal from the third data line S3 to the second switching transistor 122, via the second switch K2 under the control of the timing signal.

The first switch K1 is independent of the second switch K2. As shown in FIG. 2B, each of the first switch K1 and the second switch K2 is connected with the control line CL and the timing line CKL to receive the control signal and the timing signal, and hence can be turned on or turned off under the control of the control signal and the timing signal. Further, the first switch K1 is connected with the second data line S2 to receive the second data signal, and transmit the second data signal to a source electrode of the first switching transistor 121 and a source electrode of the second switching transistor 122 in a time division manner when the first switch K1 is turned on; also, the second switch K2 is connected with the first data line S1 and the third data line S3, to transmit the first data signal to the source electrode of the first switching transistor 121 and the third data signal to the source electrode of the second switching transistor 122 when the second switch K2 is turned on.

As shown in FIG. 2B, the drive circuit further includes: a third switching transistor 123, a fourth switching transistor 124, a fifth switching transistor 125, and a sixth switching transistor 126, where a gate electrode of the third switching transistor 123, a gate electrode of the fourth switching transistor 124, a gate electrode of the fifth switching transistor 125 and a gate electrode of the sixth switching transistor 126 are connected with the timing line CKL to receive the timing signal; a source electrode of the third switching transistor 123 and a source electrode of the fourth switching transistor 124 are both connected to the first data line S1 to receive the first data signal; a source electrode of the fifth switching transistor 125 and a source electrode of the sixth switching transistor 126 are both connected with the third data line S3 to receive the third data signal.

As described above, the timing signal controls the third switching transistor 123, the fourth switching transistor 124, the fifth switching transistor 125 and the sixth switching transistor 126 to be turned on or turned off in a time division manner. When the timing signal enables the third switching transistor 123 and the fourth switching transistor 124 to be turned on in a time division manner, the first data line S1 transmits the first data signal to a source electrode of the third switching transistor 123 and a source electrode of the fourth switching transistor 124 in a time division manner; when the timing signal enables the fifth switching transistor 125 and the sixth switching transistor 126 to be turned on in a time division manner, the third data line S3 transmits the third data signal to a source electrode of the fifth switching transistor 125 and a source electrode of the sixth switching transistor 126 in a time division manner.

As can be seen from the above, when the switch circuit 110 operates in the first operating mode, the first data line S1 transmits the first data signal to the third switch transistor 123 and the fourth switch transistor 124 in a time division manner, the second data line S2 transmits the second data signal to the first switch transistor 121 and the second switch transistor 122 in a time division manner, and the third data line S3 transmits the third data signal to the fifth switching transistor 125 and the sixth switching transistor 126 in a time division manner, so that the three data lines in the multipath selection circuit can control the six switching transistors, i.e. the multipath selection circuit operates in the 1:2 operating mode. When the switch circuit 110 operates in the second operating mode, the first data line S1 transmits the first data signal to the third switch transistor 123, the fourth switch transistor 124 and the first switching transistor 121 in a time division manner, and the third data line S3 transmits the third data signal to the fifth switching transistor 125, the sixth switching transistor 126 and the second switching transistor 122 in a time division manner, so that the two data lines in the multipath selection circuit can control the six switching transistors, i.e. the multipath selection circuit operates in the 1:3 operating mode.

The switch circuit 110 can arbitrarily switch between the first operating mode and the second operating mode according to the control signal and the timing signal, and hence the multipath selection circuit can have both the 1:2 operating mode compatible with the 1:3 operating mode, and can switch between the 1:2 operating mode and the 1:3 operating mode.

As above, when the switch circuit 110 operates in the first operating mode, one data line controls two switching transistors in a time division manner, and hence such control can be achieved by two different timing signals, so that two timing lines in multipath selection circuit is required to control the two switching transistors of the switch circuit 110; when the switch circuit 110 operates in the second operating mode, one data line controls three switching transistors in a time division manner, and hence such control can be achieved by three different timing signals, so that three timing lines in the multipath selection circuit is required to control the three switching transistors of the switch circuit 110.

Figure 2C:
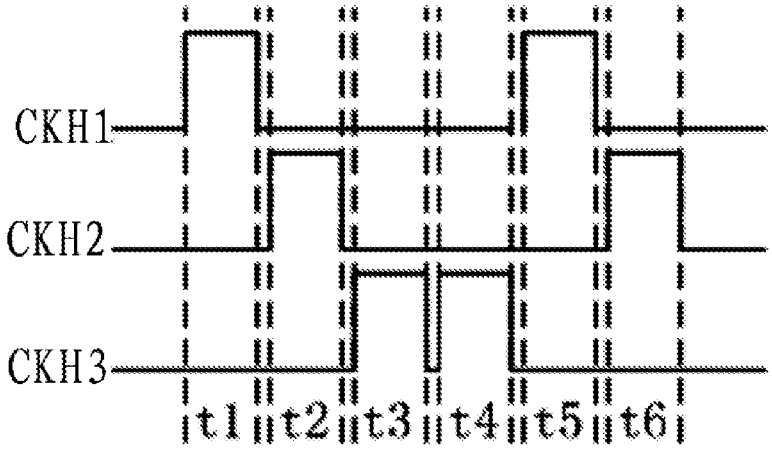
FIG. 2C is a timing diagram of the multipath selection circuit shown in FIG. 2B in the 1:3 operating mode, according to embodiments of the disclosure.
Figure 2D:
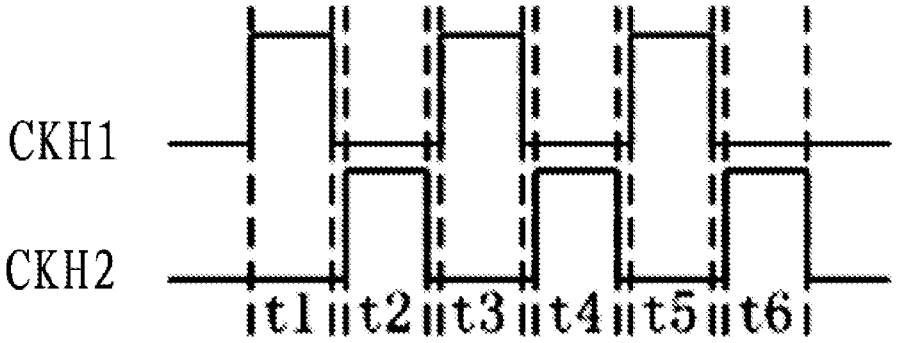
FIG. 2D is a timing diagram of the multipath selection circuit in the 1:2 operating mode, according to embodiments of the disclosure.

Considering that the multipath selection circuit is operable in both the 1:2 operating mode and the 1:3 operating mode, as shown in FIG. 2B. With reference to FIGS. 2B to 2D, the timing lines can specifically include three timing lines, i.e. a first timing line CKL1 for transmitting a first timing signal CKH1, a second timing line CKL2 for transmitting a second timing signal CKH2, and a third timing line CKL3 for transmitting a third timing signal CKH3. The first timing line CKL1 is configured to transmit the first timing signal CKH1 to a gate electrode of the third switching transistor 123, the switch circuit 110 and a gate electrode of the fifth switching transistor 125. The second timing line CKL2 is configured to transmit the second timing signal CKH2 to a gate electrode of the fourth switching transistor 124, the switch circuit 110, and a gate electrode of the sixth switching transistor 126. The third timing line CKL3 is configured to transmit the third timing signal CKH3 to the switch circuit 110.

Here, the third switching transistor 123, the fourth switching transistor 124, the fifth switching transistor 125 and the sixth switching transistor 126 all are N-type transistors. When the first timing signal CKH1 is at a high level to turn on both the third switching transistor 123 and the fifth switching transistor 125, the first data line S1 directly transmits the first data signal to a source electrode of the third switching transistor 123 and the third data line S3 transmits the third data signal to a source electrode of the fifth switching transistor 125; when the second timing signal CKH2 is at a high level to turn on both the fourth switching transistor 124 and the sixth switching transistor 126, the first data line S1 directly transmits the first data signal to a source electrode of the fourth switching transistor 124 and the third data line S3 directly transmits the third data signal to a source electrode of the sixth switching transistor 126.

FIG. 2C is a timing diagram of the multipath selection circuit shown in FIG. 2B in the 1:3 operating mode. As shown in FIG. 2C, the second switch K2 is turned on, and a clock cycle of the timing lines includes time periods t1 to t6, where, the first timing signal CKH1 outputted from the first timing line CKL1 is at a high level during the time periods t1 and t5 to control both the third switching transistor 123 and the fifth switching transistor 125 to be turned on; and the second timing signal CKH2 outputted from the second timing line CKL2 is at a high level during the time periods t2 and t6 to control both the fourth switching transistor 124 and the sixth switching transistor 126 to be turned on. The second switch K2 is turned on during the time periods t3 and t4, and since the second switch K2 is connected with the third timing line, the second switch K2 is controlled to be turned on or turned off by the third timing line CKL3, and when the third timing signal CKH3 outputted from the third timing line CKL3 is at a high level, the third timing signal CKH3 controls both the first switch transistor 121 and the second switch transistor 122 via the switch circuit 110.

FIG. 2D is a timing diagram of the multipath selection circuit in the 1:2 operating mode provided by an embodiment of the present invention. As shown in FIG. 2D, the first switch K1 is turned on, and a clock cycle of the timing lines includes time periods t1 to t6, where, since the first switch K1 is connected with the first timing line CKL1, the first timing signal CKH1 outputted from the first timing line CKL1 is at a high level during the time periods t1, t3 and t5 to directly control both the third switching transistor 123 and the fifth switching transistor 125 to be turned on, and control the first switching transistor 121 to be turned on via the switch circuit 110; also, since the first switch K1 is connected with the second timing line CKL2, the second timing signal CKH2 outputted from the second timing line CKL2 is at a high level during the time periods t2, t4 and t6 to directly control both the fourth switching transistor 124 and the sixth switching transistor 126 to be turned on, and control the second switching transistor 122 to be turned on via the switch circuit 110.

Figure 2E:
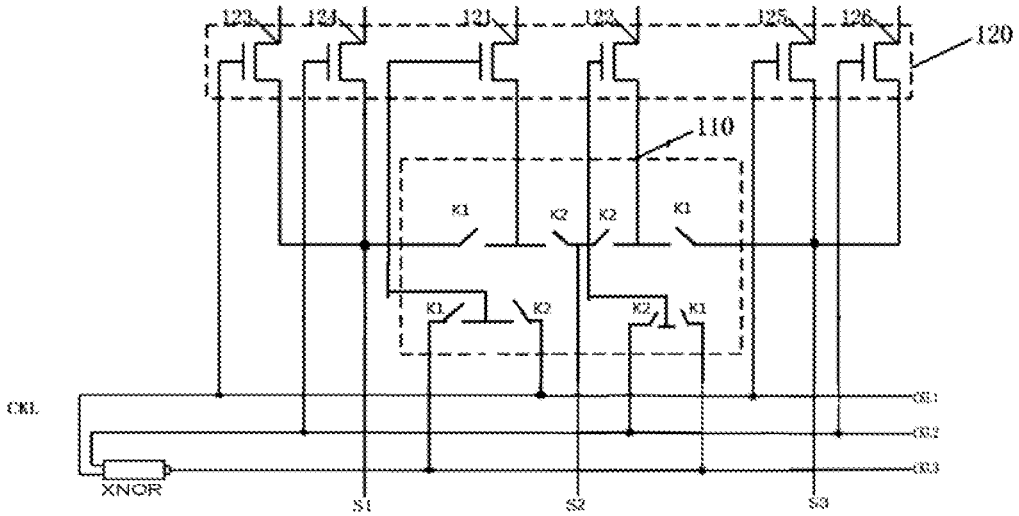
FIG. 2E is a schematic diagram of another multipath selection circuit, according to embodiments of the disclosure.

FIG. 2E is a schematic diagram of another multipath selection circuit, according to embodiments of the disclosure. As shown in FIGS. 2C to 2E, the multipath selection circuit has two timing lines CKL1 and CKL2 to output three timing signals CKH1, CKH2 and CKH3 correspondingly.

The timing signals CKH1, CKH2, and CKH3 control the switch circuit 110 in a time division manner. When one of the timing signals CKH1 and CKH2 is at a high level, the timing signal having a high level controls the switch circuit 110, but the timing signal CKH3 is not intended to control the switch circuit 110 at this time, so that the timing signal CKH3 should be at a low level; when the timing signals CKH1 and CKH2 both are at a low level, the CKH3 is intended to control the switch circuit 110 and hence should be at a high level. In view of this, a logical relation among the timing signals CKH1, CKH2 and CKH3 should be CKH3=CKH1 ⊙CKH2. In other words, the third timing line CKL3 further comprises an equivalence gate (XNOR gate), where, the first timing line CKL1 is connected with a first input terminal of the XNOR gate, the second timing line CKL2 is connected with a second input terminal of the XNOR gate, and the third timing signal is outputted from an output terminal of the XNOR gate, so that the multipath selection circuit can output three different timing signals via two timing lines in order to satisfy the requirement for the 1:2 operating mode and the 1:3 operating mode. When the first timing signal CKH1 is at a high level, the third timing signal CKH3 is at a low level; when the second timing signal CKH2 is at a high level, the third timing signal CKH3 is at a low level; and only when the timing signal CKH1 and CKH2 are at a low level, the third timing signal CKH3 outputted from the third timing line CKL3 is at a high level.

Figure 3A:
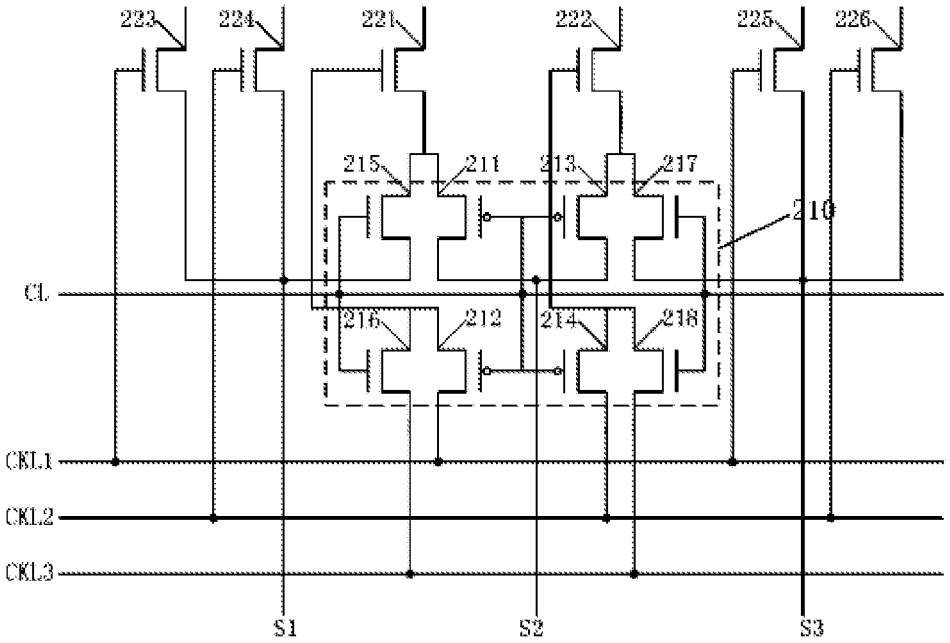
FIG. 3A is a schematic diagram of a multipath selection circuit, according to embodiments of the disclosure.

FIG. 3A is a schematic diagram of a multipath selection circuit, according to embodiments of the disclosure. As can be seen from the above, the first switch and the second switch cannot be turned on concurrently. As shown in FIG. 3A, the first switch and the second switch can each include a plurality of transistors, where, the type of transistors contained in the first switch is different from the type of transistors contained in the second switch. Here, the first switch includes: a first P-type transistor 211, a second P-type transistor 212, a third P-type transistor 213, and a fourth P-type transistor 214; and the second switch includes: a first N-type transistor 215, a second N-type transistor 216, a third N-type transistor 217, and a fourth N-type transistor 218.

Gate electrodes of the four transistors of the first switch are configured to receive the control signal, and gate electrodes of the four transistors of the second switch are configured to receive the control signal. Since the control signal received by the first switch is the same as the control signal received by the second switch, and the type of transistors of the first switch is contrary to the type of transistors of the second switch (i.e., the former is P-type and the latter is N-type), the second switch is turned off when the first switch is turned on, so that the second data line S2 transmits the second data signal to the first switch transistor 221 and the second switch transistor 222 in a time division manner via the first switch, thereby the switch circuit 210 is operating in the first operating mode and the multipath selection circuit is operating in the 1:2 operating mode; also, the second switch is turned on when the first switch is turned off, so that the first data line S1 transmits the first data signal to the first switch transistor 221 via the second switch and the third data line S3 transmits the third data signal to the second switch transistor 222 via the second switch, thereby the switch circuit 210 is operating in the second operating mode and the multipath selection circuit is operating in the 1:3 operating mode.

As shown in FIG. 3A, if the first switch includes four P-type transistors and the second switch includes four N-type transistors, a drain electrode of the first N-type transistor 215 and a source electrode of the first P-type transistor 211 are connected with a source electrode of the first switching transistor 221, a drain electrode of the second N-type transistor 216 and a source electrode of the second P-type transistor are connected with a gate electrode of the first switching transistor 221, a drain electrode of the third N-type transistor 217 and a source electrode of third P-type transistor 213 are connected with a source electrode of the second switching transistor 222, and a drain electrode of the fourth N-type transistor 218 and a source electrode of the fourth P-type transistor 214 are connected with a gate electrode of the second switching transistor 222; and a source electrode of the second N-type transistor 216, a drain electrode of the second P-type transistor 212, a source electrode of the fourth N-type transistor 218 and a drain electrode of the fourth P-type transistor 214 receive the timing signals. Here, if the timing line includes the first timing line CKL1, the second timing line CKL2 and the third timing line CKL3, a source electrode of the second N-type transistor 216 is connected with the third timing line, a drain electrode of the second P-type transistor 212 is connected with the first timing line, a source electrode of the fourth N-type transistor 218 is connected with the third timing line, a drain electrode of the fourth P-type transistor 214 is connected with the second timing line; a source electrode of the first N-type transistor 215 is connected with the first data line S1 to receive the first data signal; a drain electrode of the first P-type transistor 211 and a drain electrode of the third P-type transistor 213 are connected with the second data line S2 to receive the second data signal; and a source electrode of the third N-type transistor 217 is connected with the third data line S3 to receive the third data signal.

When the control signal is at a high level, the second switch is turned on. In combination with timing diagram shown in FIG. 2C, the multipath selection circuit specifically operates as follows: during the time period t1, the first timing signal CKH1 is at a high level, and the third switching transistor 223 is turned on, so that a source electrode of the third switching transistor 223 receives the first data signal outputted from the first timing line S1, thereby outputting the first data signal from a drain electrode of the third switching transistor 223; during the time period t2, the second timing signal CKH2 is at a high level, and the fourth switching transistor 224 is turned on, thereby outputting the first data signal from a drain electrode of the fourth switching transistor 224; during the time period t3, the third timing signal CKH3 is at a high level and the control signal is at a high level, both the second N-type transistor 216 and the first N-type transistor 215 are turned on, so that a drain current is outputted from a drain electrode of the second N-type transistor 216 and transmitted to a gate electrode of the first switching transistor 221 to turn on the first switching transistor 221, and a drain electrode of the first N-type transistor 215 transmits the first data signal outputted from the first timing line S1 to a source electrode of the first switching transistor 221, and the first data signal in turn is outputted from a drain electrode of the first switching transistor 221 which is turned on; during the time period t4, the third timing signal CKH3 is at a high level and the control signal is at a high level, both the fourth N-type transistor 218 and the third N-type transistor 217 are turned on, so that a drain current is outputted from the fourth N-type transistor 218 to turn on the second switching transistor 222, and a drain electrode of the third N-type transistor 217 transmits the third data signal outputted from the third timing line S3 to a source electrode of the second switching transistor 222, and the third data signal in turn is outputted from a drain electrode of the second switching transistor 222 which is turned on; during the timing period t5, the first timing signal CKH1 is at a high level, the fifth switching transistor 225 is turned on, so that the third data signal is outputted from a drain electrode of the fifth switching transistor 225; during the timing period t6, the second timing signal CKH2 is at a high level, the sixth switching transistor 226 is turned on, so that the third data signal is outputted from a drain electrode of the sixth switching transistor 226.

It can be seen that the second switch is turned on when the control signal is at a high level, so that the first data signal from the first timing line S1 in the multipath selection circuit is transmitted to the third switching transistor 223, the fourth switching transistor 224 and the first switching transistor 221 in a time division manner, and the third data signal from the third timing line S3 in the multipath selection circuit is transmitted to the second switching transistor 222, the fifth switching transistor 225 and the sixth switching transistor 223 in a time division manner, thereby controlling three switching transistors by one data line in a time division manner and operating the multipath selection circuit in the 1:3 operating mode.

When the control signal is at a low level, the first switch is turned on. In combination with the timing diagram shown in FIG. 2D, the multipath selection circuit specifically operates as follows: the first timing signal CKH1 is at a high level during the time period t1, the third switching transistor 223 is turned on, and the first data signal is outputted from a drain electrode of the third switching transistor 223; the second timing signal CKH2 is at a high level during the time period t2, the first data signal is outputted from a drain electrode of the fourth switching transistor 224; the first timing signal CKH1 is at a high level and the control signal is at a low level during the time period t3, both the second P-type transistor 212 and the first P-type transistor 211 are turned on, and the first switching transistor 221 is turned on, a source electrode of the first P-type transistor 211 transmits the second data signal to a source electrode of the first switching transistor 221 and the second data signal is outputted from a drain electrode of the first switching transistor 221 which is turned on; the second timing signal CKH2 is at a high level and the control signal is at a low level during the time period t4, both the fourth P-type transistor 214 and the third P-type transistor 213 are turned on, and the second switching transistor 222 is turned on, a source electrode of the second switching transistor 222 receives the second data signal transmitted from a source electrode of the third P-type transistor 213 and the second data signal is outputted from a drain electrode of the second switching transistor 222; if the first timing signal CKH1 is at a high level at the time period t5, the third data signal is outputted from a drain electrode of the fifth switching transistor 225; if the second timing signal CKH2 is at a high level at the time period t6, the third data signal is outputted from a drain electrode of the sixth switching transistor 226.

It can be seen that the first switch is turned on when the control signal is at a low level, so that one data line from the multipath selection path controls two switching transistor in a time division manner, thereby operating the multipath selection circuit in the 1:2 operating mode.

As can be seen from the above, the multipath selection circuit is operable in both the 1:3 multipath selection circuit and the 1:2 multipath selection circuit, and when the control signal inputted to the multipath selection circuit is at a high level, the multipath selection circuit is the 1:3 multipath selection circuit; when the control signal inputted to the multipath selection circuit is at a low level, the multipath selection circuit is the 1:2 multipath selection circuit. Therefore, the operating mode of the multipath selection circuit can be switched between the 1:3 operating mode and the 1:2 operating mode by controlling the level of the control signal inputted thereto.

Figure 3B:
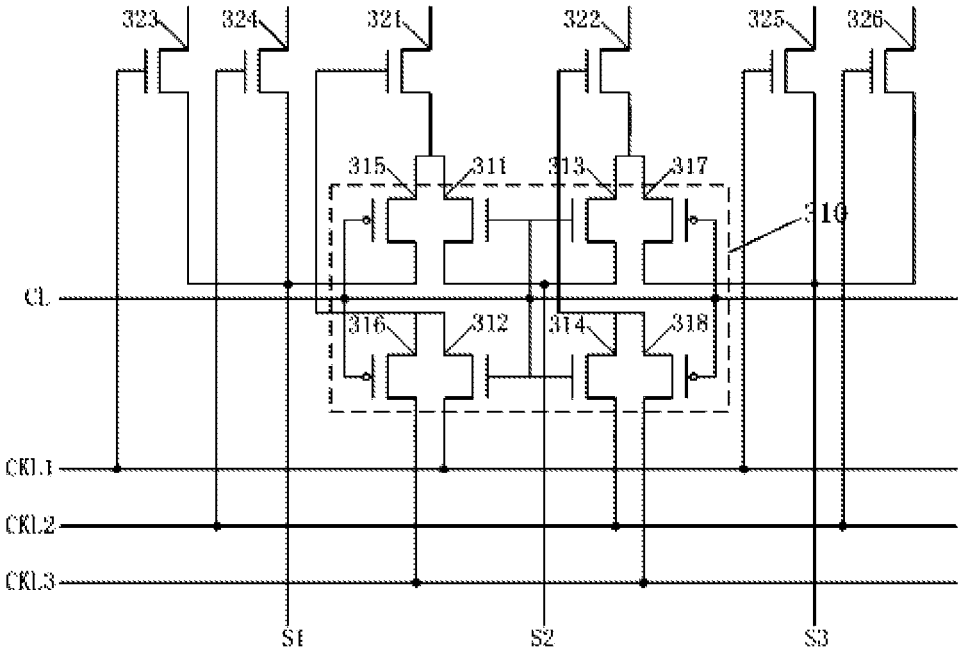
FIG. 3B is a schematic diagram of a multipath selection circuit, according to embodiments of the disclosure.

FIG. 3B is a schematic diagram of a multipath selection circuit, according to embodiments of the disclosure. In a switching circuit 310 of the multipath selection circuit, the first switch and the second switch may further be configured to include N-type transistors and P-type transistors, respectively, where, the first switch includes: a first N-type transistor 311, a second N-type transistor 312, a third N-type transistor 313, and the fourth N-type transistor 314; the second switch includes a first P-type transistor 315, a second P-type transistor 316, a third P-type transistor 317, and a fourth P-type transistor 318.

As shown in FIG. 3B, gate electrodes of the four transistors of the first switch receive the control signal, and gate electrodes of the four transistors of the second switch receive the control signal; a drain electrode of the first N-type transistor 311 and a source electrode of the first P-type transistor 315 are connected with a source electrode of the first switching transistor 321, a drain electrode of the second N-type transistor 312 and a source electrode of the second P-type transistor 316 are connected with a gate electrode of the first switching transistor 321, a drain electrode of the third N-type transistor 313 and a source electrode of the third P-type transistor 317 are connected with a source electrode of the second switching transistor 322, and a drain electrode of the fourth N-type transistor 314 and a source electrode of the fourth P-type transistor 318 are connected with a gate electrode of the second switching transistor 322; and a source electrode of the second N-type transistor 312, a drain electrode of the second P-type transistor 316, a source electrode of the fourth N-type transistor 314 and a drain electrode of the fourth P-type transistor 318 receive timing signals. Here, the timing line includes the first timing line CKL1, the second timing line CKL2 and the third timing line CKL3, and specifically, a source electrode of the second N-type transistor 312 is connected with the first timing line, a drain electrode of the second P-type transistor 316 is connected with the third timing line, a source electrode of the fourth N-type transistor 314 is connected with the second timing line, and a drain electrode of the fourth P-type transistor 318 is connected with the third timing line; and a drain electrode of the first P-type transistor 315 receives the first data signal, both a source electrode of the first N-type transistor 311 and a source electrode of the third N-type transistor 313 receive the second data signal, and a drain electrode of the third P-type transistor 317 receives the third data signal.

As can be seen from the above, when the control signal inputted to the multipath selection circuit is at a high level, the first switch is turned on and the second switch is turned off; under the control of the timing signal as shown in FIG. 2D, the second data line S2 transmits the second data signal to a source electrode of the first switching transistor 321 via a drain electrode of the first N-type transistor 311 and transmits the second data signal to a source electrode of the second switching transistor 322 via a drain electrode of the third N-type transistor 313; the first data line S1 transmits the first data signal to a source electrode of the third switching transistor 323 and a source electrode of the fourth switching transistor 324 in a time division manner, and the third data line S3 transmits the third data signal to a source electrode of the fifth switching transistor 325 and a source electrode of the sixth switching transistor 326 in a time division manner, and hence such multipath selection circuit is the 1:2 multipath selection circuit. When the control signal inputted to the multipath selection circuit is at a low level, the first switch is turned off and the second switch is turned on; under the control of the timing signal as shown in FIG. 2C, the first data signal outputted from the first timing line S1 is transmitted to a source electrode of the first switching transistor 321 via a source electrode of the first P-type transistor 315, the third data signal outputted from the third timing line S3 is transmitted to a source electrode of the second switching transistor 322 via a source electrode of the third P-type transistor 317, the first data signal outputted from the first timing line S1 is transmitted to a source electrode of the third switching transistor 323 and a source electrode of the fourth switching transistor 324 in a time division manner, and the third data signal outputted from the first timing line S3 is transmitted to a source electrode of the fifth switching transistor 325 and a source electrode of the sixth switching transistor 326 in a time division manner, and hence such multipath selection circuit is the 1:3 multipath selection circuit.

As such, the multipath selection circuit is operable in the 1:3 operating mode and the 1:2 operating mode, and can be arbitrarily switched between the 1:3 multipath selection circuit and the 1:2 multipath selection circuit according to the level of the inputted control signal.

Figure 3C:
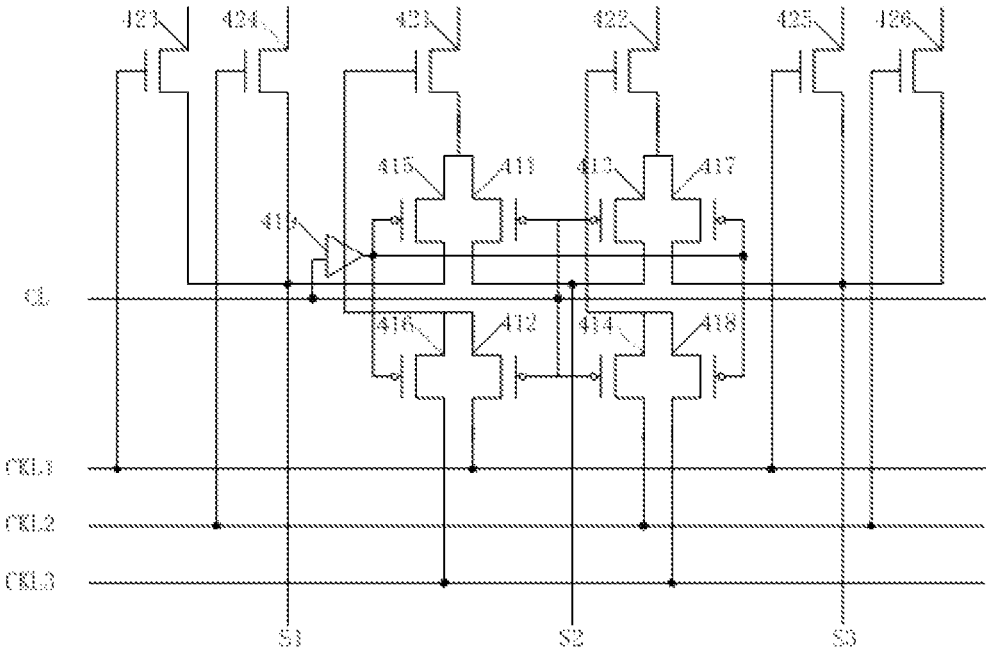
FIG. 3C is a schematic diagram of a multipath selection circuit, according to embodiments of the disclosure.

FIG. 3C is a schematic diagram of a multipath selection circuit, according to embodiments of the disclosure. As shown in FIG. 3C, the first switch includes: a first P-type transistor 411, a second P-type transistor 412, a third P-type transistor 413, and a fourth P-type transistor 414; and the second switch includes: a fifth P-type transistor 415, a sixth P-type transistor 416, a seventh P-type transistor 417, an eighth P-type transistor 418 and a first inverter 419 connected to the fifth P-type transistor 415, the sixth P-type transistor 416, the seventh P-type transistor 417, and the eighth P-type transistor 418, where, an input terminal of the first inverter 419 is connected with the control line to receive the control signal.

As shown in FIG. 3C, gate electrodes of the four transistors of the first switch receive the control signal, gate electrodes of the four transistors of the second switch are connected with an output terminal of the first inverter 419, the input terminal of the first inverter 419 is connected with the control line to receive the control signal, both a source electrode of the fifth P-type transistor 415 and a source electrode of the first P-type transistor 411 are connected with a source electrode of the first switching transistor 421, both a source electrode of the sixth P-type transistor 416 and a source electrode of the second P-type transistor 412 are connected with a gate electrode of the first switching transistor 421, both a source electrode of the seventh P-type transistor 417 and a source electrode of the third P-type transistor 413 are connected with a source electrode of the second switching transistor 422, and both a source electrode of the eighth P-type transistor 418 and a source electrode of the fourth P-type transistor 414 are connected with a gate electrode of the second switching transistor 422; a drain electrode of the sixth P-type transistor 416 is connected with the third timing line, a drain electrode of the second P-type transistor 412 is connected with the first timing line, a drain electrode of the eighth P-type transistor 418 is connected with the third timing line, and a drain electrode of the fourth P-type transistor 414 is connected with the second timing line; and a drain electrode of the fifth P-type transistor 415 is connected with the first data line S1 to receive the first data signal, both a drain electrode of the first P-type transistor 411 and a drain electrode of the third P-type transistor 413 are connected with the second data line S2 to receive the second data signal and a drain electrode of the seventh P-type transistor 417 is connected with the third data line S3 to receive the third data signal.

When the control signal is at a low level, the first switch receives the control signal having a low level to turn on the first switch, the input terminal of the first inverter 419 of the second switch receives the control signal having a low level, and the output terminal of the first inverter 419 in turn outputs a signal having a high level to the four P-type transistors of the second switch to turn off the second switch; when the first switch is turned on, the second data signal is transmitted to a source electrode of the first switching transistor 421 via a source electrode of the first P-type transistor 411 and transmitted to a source electrode of the second switching transistor 422 via a source electrode of the third P-type transistor 413. The first data line S1 transmits the first data signal to a source electrode of the third switching transistor 423 and a source electrode of the fourth switching transistor 424 in a time division manner, and the third data line S3 transmits the third data signal to a source electrode of the fifth switching transistor 425 and a source electrode of the sixth switching transistor 426 in a time division manner. When the control signal is at a high level, the first switch receives the control signal having a high level to turn off the first switch, the input terminal of the first inverter 419 of the second switch receives the control signal having a high level, and the output terminal of the first inverter 419 in turn outputs a signal having a low level to the four P-type transistors of the second switch to turn on the second switch; when the second switch is turned on, the first data signal outputted from the first timing line S1 is transmitted to the source electrode of the first switch transistor 421 via the source electrode of the fifth P-type transistor 415, and the third data signal outputted from the third timing line S3 is transmitted to the source electrode of the second switching transistor 422 via the source electrode of the seventh P-type transistor 417. The first data signal outputted from the first timing line S1 is transmitted to the source electrode of the third switching transistor 423 and the source electrode of the fourth switching transistor 424 in a time division manner, and the third data signal outputted from the third timing line S3 is transmitted to the source electrode of the fifth switching transistor 425 and the source electrode of the sixth switching transistor 426 in a time division manner.

As such, the multipath selection circuit is operable in both the 1:3 operating mode and the 1:2 operating mode and can be switched between the 1:3 operating mode and the 1:2 operating mode according to the level of the inputted control signal when the first switch or the second switch is turned on.

Figure 3D:
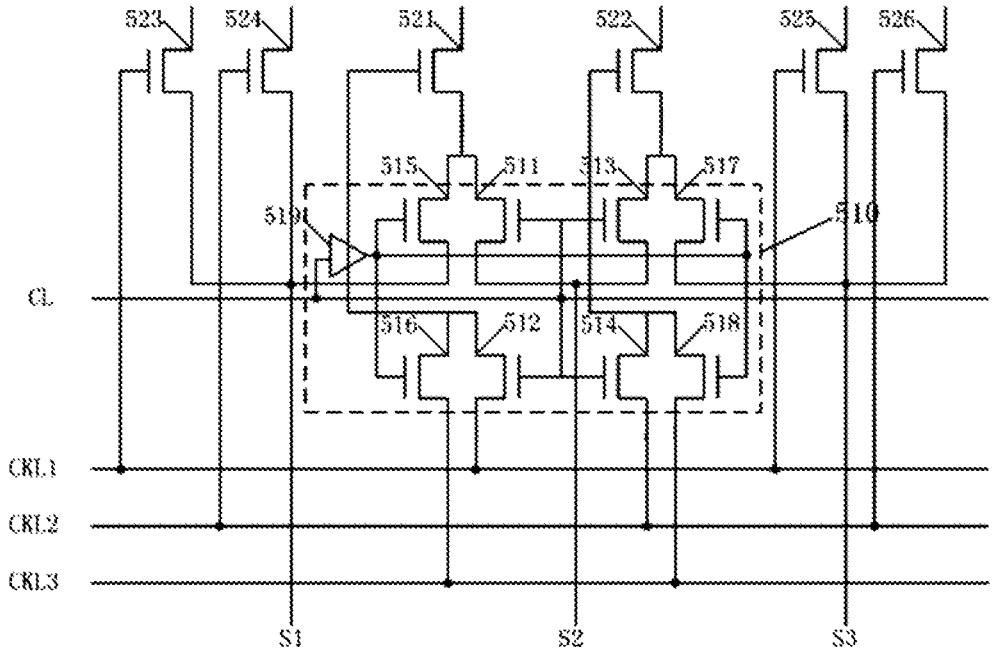
FIG. 3D is a schematic diagram of another multipath selection circuit, according to embodiments of the disclosure.

FIG. 3D is a schematic diagram of another multipath selection circuit, according to embodiments of the disclosure. As shown in FIG. 3D, the first switch includes: a first N-type transistor 511, a second N-type transistor 512, a third N-type transistor 513, and a fourth N-type transistor 514; the second switch includes: a fifth N-type transistor 515, a sixth N-type transistor 516, a seventh N-type transistor 517, an eighth N-type transistor 518 and a second inverter 519 connected to the fifth N-type transistor 515, the sixth N-type transistor 516, the seventh N-type transistor 517, and the eighth N-type transistor 518, where, an input terminal of the second inverter 519 is connected with the control line to receive the control signal and an output terminal of the second inverter 519 is connected with the four N-type transistors of the second switch.

When the control signal is at a high level, the first switch receives the control signal having a high level depending on the timing signals to turn on the first switch, the input terminal of the second inverter 519 of the second switch receives the control signal having a high level, and the output terminal of the second inverter 519 in turn outputs a signal having a low level to the four N-type transistors of the second switch to turn off the second switch, so that the switch circuit 510 is operating in the first operating mode; when the control signal is at a low level, the first switch receives the control signal having a low level depending on the timing signals to turn off the first switch, the input terminal of the second inverter 519 of the second switch receives the control signal having a low level, and the output terminal of the second inverter 519 in turn outputs a signal having a high level to turn on the second switch, so that the switch circuit 510 is operating in the second operating mode.

As shown in FIG. 3D, gate electrodes of the four transistors of the first switch receive the control signal, gate electrodes of the four transistors of the second switch are connected with an output terminal of the second inverter 519, both a drain electrode of the fifth N-type transistor 515 and a drain electrode of the first N-type transistor 511 are connected with a source electrode of the first switching transistor 521, both a drain electrode of the sixth N-type transistor 516 and a drain electrode of the second N-type transistor 512 are connected with a gate electrode of the first switching transistor 521, both a drain electrode of the seventh N-type transistor 517 and a drain electrode of the third N-type transistor 513 are connected with a source electrode of the second switching transistor 522, and both a drain electrode of the eighth N-type transistor 518 and a drain electrode of the fourth N-type transistor 514 are connected with a gate electrode of the second switching transistor 522; a source electrode of the sixth N-type transistor 516 is connected with the third timing line, a source electrode of the second N-type transistor 512 is connected with the first timing line, a source electrode of the eighth N-type transistor 518 is connected with the third timing line, and a source electrode of the fourth N-type transistor 514 is connected with the second timing line; and a source electrode of the fifth N-type transistor 515 is connected with the first data line S1 to receive the first data signal, both a source electrode of the first N-type transistor 511 and a source electrode of the third N-type transistor 513 are connected with the second data line S2 to receive the second data signal, and a source electrode of the seventh N-type transistor 517 is connected with the third data line S3 to receive the third data signal.

As can be seen from the above, when the switch circuit 510 is operating in the first operating mode, the second data signal outputted from the second timing line S2 is transmitted to the source electrode of the first switching transistor 521 via the first N-type transistor 511, and transmitted to the source electrode of the second switching transistor 522 via the third N-type transistor 513; the first data line S1 transmits the first data signal to a source electrode of the third switching transistor 523 and a source electrode of the fourth switching transistor 524 in a time division manner, and the third data line S3 transmits the third data signal to a source electrode of the fifth switching transistor 525 and a source electrode of the sixth switching transistor 526 in a time division manner. When the switch circuit 510 is operating in the second operating mode, the first data signal outputted from the first timing line S1 is transmitted to the source electrode of the first switching transistor 521 via the fifth N-type transistor 515, and the third data signal outputted from the first timing line S3 is transmitted to the source electrode of the second switching transistor 522 via the seventh N-type transistor 517. The first data signal outputted from the first timing line S1 is transmitted to a source electrode of the third switching transistor 523 and a source electrode of the fourth switching transistor 524 in a time division manner, and the third data signal outputted from the third timing line S3 is transmitted to a source electrode of the fifth switching transistor 525 and a source electrode of the sixth switching transistor 526 in a time division manner.

As such, the multipath selection circuit is operable in both the 1:3 operating mode and the 1:2 operating mode, and can be switched between the 1:3 operating mode and the 1:2 operating mode according to the control signal and the timing signals.

As shown in FIGS. 3A to 3D, the first switch and the second switch are connected with a control line CL and configured to receive the same control signal, and if the first switch is formed by the P-type transistors, the second switch is formed by the N-type transistors or a combination of the P-type or N-type transistors and the inverter. In some embodiments, the first switch and the second switch can be controlled separately, i.e. the first switch is connected with a control line CL1, and the second switch is connected with another control line CL2. As such, the two control lines CL1 and CL2 respectively control the first switch and the second switch, thus achieving the switching between the operating modes of the multipath selection circuit.

Optionally, the control lines include: a first control line for transmitting a first control signal and a second control line for transmitting a second control signal; the first control signal controls the first switch to be turned on or turned off, and the second control signal controls the second switch to be turned on or turned off. The first switch is configured to receive the first control signal, and the second switch is configured to receive the second control signal; or the first switch is configured to receive the second control signal, and the second switch is configured to receive the first control signal. In some embodiments, the first switch is configured to receive the first control signal, and the second switch is configured to receive the second control signal, for example.

As described above, the switch circuit is operating in the first operating mode when the first switch is turned on and is operating in the second operating mode when the second switch is turned on. As such, two operating modes of the switch circuit are independent of each other, so that the first control signal and the second control signal separately control the first switch and the second switch.

In some embodiments, for example, in the multipath selection circuit shown in FIG. 3A, the first switch includes four P-type transistors and is connected with the first control line to receive the first control signal, and the second switch includes four N-type transistors and is connected with the second control line to receive the second control signal. To operate the multipath selection circuit in the 1:3 operating mode, the first control signal and the second control signal are set at a high level, and hence the second switch is turned on after receiving the second control signal, and the first switch is turned off after receiving the first control signal, thus the first data signal outputted from the first timing line S1 is transmitted to the first switching transistor 221, and the third data signal outputted from the third timing line S3 is transmitted to the second switching transistor 222; also, the first data signal outputted from the first timing line S1 is further transmitted to the third switching transistor 223 and the fourth switching transistor 224 in a time division manner, and the third data signal outputted from the third timing line S3 is transmitted to both the fifth switching transistor 225 and the sixth switching transistor 226 in a time division manner, so that the multipath selection circuit operates in the 1:3 operating mode.

To operate the multipath selection circuit in the 1:2 operating mode, the first control signal and the second control signal are set at a low level, and hence the second switch is turned off after receiving the second control signal, and the first switch is turned on after receiving the first control signal, thus the second data signal outputted from the second timing line S2 is transmitted to the first switching transistor 221 and the second switching transistor 222 in a time division manner, the first data signal outputted from the first timing line S1 is further transmitted to the third switching transistor 223 and the fourth switching transistor 224 in a time division manner, and the third data signal outputted from the third timing line S3 is transmitted to the fifth switching transistor 225 and the sixth switching transistor 226 in a time division manner, so that the multipath selection circuit operates in the 1:2 operating mode.

The control process of the two control lines of the multipath selection circuit shown in FIG. 3B is similar to the control process of the two control lines of the multipath selection circuit shown in FIG. 3A, which is not repeated here.

In some embodiments, for example, also in the multipath selection circuit shown in FIG. 3C, the first switch includes four P-type transistors and is connected with the first control line to receive the first control signal, and the second switch includes four P-type transistors and the first inverter 419, and the input terminal of the first inverter 419 from the second switch is connected with the second control line to receive the second control signal. To operate the multipath selection circuit in the 1:3 operating mode, the first control signal and the second control signal are set at a high level, and hence the input terminal of the first inverter 419 from the second switch outputs a low level to the four P-type transistors of the second switch after receiving the second control signal to turn on the second switch, and the first switch is turned off after receiving the first control signal, thus the first data signal outputted from the first timing line S1 is transmitted to the first switching transistor 421 and further transmitted to the third switching transistor 423 and the fourth switching transistor 424 in a time division manner, the third data signal outputted from the third timing line S3 is transmitted to the second switching transistor 422 and further transmitted to the fifth switching transistor 425 and the sixth switching transistor 426 in a time division manner, so that the multipath selection circuit operates in the 1:3 operating mode.

To operate the multipath selection circuit in the 1:2 operating mode, the first control signal and the second control signal are set at a low level, and hence the second switch is turned off after receiving the second control signal, and the first switch is turned on after receiving the first control signal, thus the second data signal outputted from the second timing line S2 is transmitted to the first switching transistor 421 and the second switching transistor 422 in a time division manner, the first data signal outputted from the first timing line S1 is further transmitted to the third switching transistor 423 and the fourth switching transistor 424 in a time division manner, and the third data signal outputted from the third timing line S3 is transmitted to the fifth switching transistor 425 and the sixth switching transistor 426 in a time division manner, so that the multipath selection circuit operates in the 1:2 operating mode.

The control process of the two control lines of the multipath selection circuit shown in FIG. 3D is similar to the control process of the two control lines of the multipath selection circuit shown in FIG. 3C, which is not repeated here.

As such, the first control line and the second line separately control the first switch and the second switch, so that the first switch may further include four N-type transistors, and the second switch can further include four N-type transistors; or the first switch may further include four P-type transistors, and the second switch may further include four P-type transistors. The first control signal is transmitted to the first switch, and the second control signal is transmitted to the second switch, in this case, the level of the first control signal is inverse to the level of the second control signal in terms of high and low levels, so that the multipath selection circuit can be operable in both the 1:3 operating mode and the 1:2 operating mode, and can be switched between the 1:3 operating mode and the 1:2 operating mode.

Figure 4A:
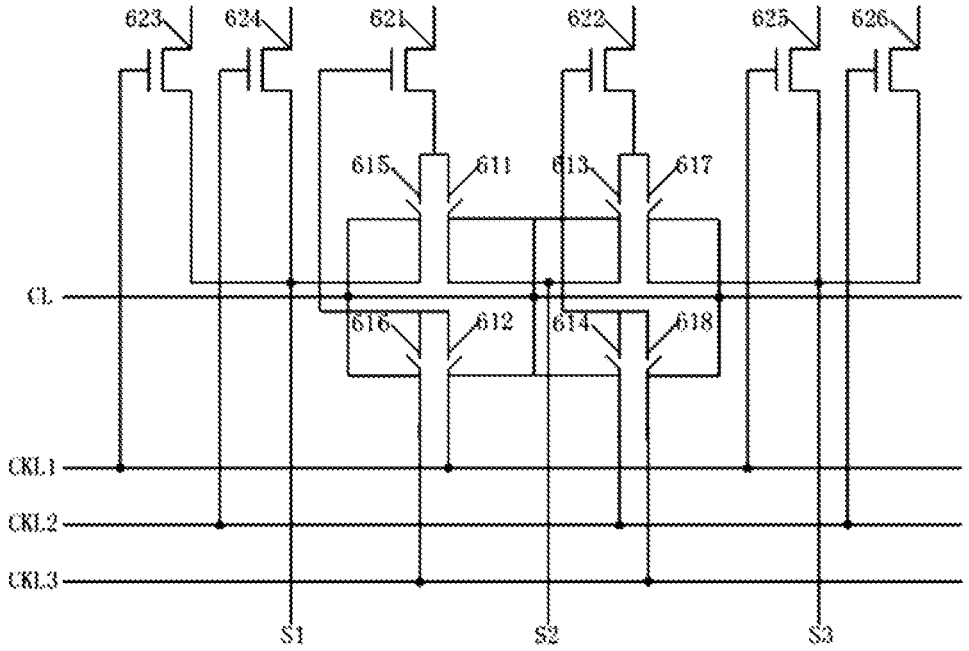
FIG. 4A is a schematic diagram of a multipath selection circuit, according to embodiments of the disclosure.

FIG. 4A is a schematic diagram of the multipath selection circuit, according to embodiments of the disclosure. As shown in FIG. 4A, the multipath selection circuit includes: a first switch and a second switch, where, the first switch includes a first sub-switch 611, a second sub-switch 612, a third sub-switch 613 and a fourth sub-switch 614, and the second switch includes a fifth sub-switch 615, a sixth sub-switch 616, a seventh sub-switch 617 and an eighth sub-switch 618; the multipath selection circuit further includes a first switching transistor 621, a second switching transistor 622, a first data line S1 for transmitting a first data signal, a second data line S2 for transmitting a second data signal, a third data line S3 for transmitting a third data signal, a first timing line CKL1 for transmitting a first timing signal, a second timing line CKL2 for transmitting a second timing signal and a third timing line CKL3 for transmitting a third timing signal.

A source electrode of the first switching transistor 621 is connected with the second data line S2 via the first sub-switch 611 to receive the second data signal and is connected with the first data line S1 via the fifth sub-switch 615 to receive the first data signal, and a gate electrode of the first switching transistor 621 is connected with the first timing line CKL1 via the second sub-switch 612 to receive the first timing signal and is connected with the third timing line CKL3 via the sixth sub-switch 616 to receive the third timing signal. A source electrode of the second switching transistor 622 is connected with the second data line S2 via the third sub-switch 613 to receive the second data signal and is connected with the third data line S3 via the seventh sub-switch 617 to receive the third data signal, and a gate electrode of the second switching transistor 622 is connected with the second timing line CKL2 via the fourth sub-switch 614 to receive the second timing signal and is connected with the third timing line CKL3 via the eighth sub-switch 618 to receive the third timing signal. The four sub-switches of the first switch are turned on or turned off simultaneously, and the four sub-switches of the second switch are turned on or turned off simultaneously; when the first switch is turned on, the second switch is turned off, and when the first switch is turned off, the second switch is turned on.

As shown in FIG. 4A, the multipath selection circuit further includes a control line CL for transmitting a control signal, where, the first switch and the second switch both are connected with the control line, so that the first switch and the second switch receive the same control signal. In order for different operating modes of the multipath selection circuit, here the four sub-switches of the first switch may be configured as P-type transistors, and the four sub-switches of the second switch may be configured as N-type transistors; or, the four sub-switches of the first switch may be configured as N-type transistors, and the four sub-switches of the second switch may be configured as P-type transistors. A gate electrode of the P-type transistor and a gate electrode of the N-type transistor are connected with the control line to receive the control signal. When the control signal is at a high level, the N-type transistor is turned on and the P-type transistor is turned off. When the control signal is at a low level, the N-type transistor is turned off and the P-type transistor is turned on.

Additionally, when the multipath selection circuit has a control line, further, the four sub-switches of the first switch may be configured as N-type transistors, and the four sub-switches of the second switch may be configured as N-type transistors and the second switch further has a inverter, where, an input terminal of the inverter is connected with the control line, an output terminal of the inverter is connected with gate electrodes of the four N-type transistors of the second switch. In this case, when the control signal is at a high level, the first switch is turned on and the second switch is turned off; and when the control signal is at a low level, the first switch is turned off and the second switch is turned on. Alternately, the four sub-switches of the first switch may be configured as P-type transistors, and the four sub-switches of the second switch may be configured as P-type transistors and the second switch further has a inverter, where, an input terminal of the inverter is connected with the control line, an output terminal of the inverter is connected with gate electrodes of the four P-type transistors of the second switch. In this case, when the control signal is at a high level, the first switch is turned off and the second switch is turned on; and when the control signal is at a low level, the first switch is turned on and the second switch is turned off.

When the first switch is turned on, the second data signal outputted from the second timing line S2 is transmitted to the source electrode of the first switching transistor 621 via the first sub-switch 611, and transmitted to the source electrode of the second switching transistor 622 via the third sub-switch 613; when the second switch is turned on, the first data signal outputted from the first timing line S1 is transmitted to the source electrode of the first switching transistor 621 via the fifth sub-switch 615 and the third data signal outputted from the third timing line S3 is transmitted to the source electrode of the second switching transistor 622 via the seventh sub-switch 617, so that the multipath selection circuit operates in different operating modes.

As shown in FIG. 4A, the multipath selection circuit further includes a third switching transistor 623, a fourth switching transistor 624, a fifth switching transistor 625, and a sixth switching transistor 626; both a source electrode of the third switching transistor 623 and a source electrode of the fourth switching transistor 624 are connected with the first data line S1 to receive the first data signal, a gate electrode of the third switching transistor 623 is connected with the first timing line to receive the first timing signal, and a gate electrode of the fourth switching transistor 624 is connected with the second timing line to receive the second timing signal, both a source electrode of the fifth switching transistor 625 and a source electrode of the sixth switching transistor 626 are connected with the third data line S3 to receive the third data signal, a gate electrode of the fifth switching transistor 625 is connected with the first timing line to receive the first timing signal, and a gate electrode of the sixth switching transistor 626 is connected with the second timing line to receive the second timing signal. In this case, when the first switch is turned on, the multipath selection circuit operates in the 1:2 operating mode; and when the second switch is turned on, the multipath selection circuit operates in the 1:3 operating mode.

Figure 4B:
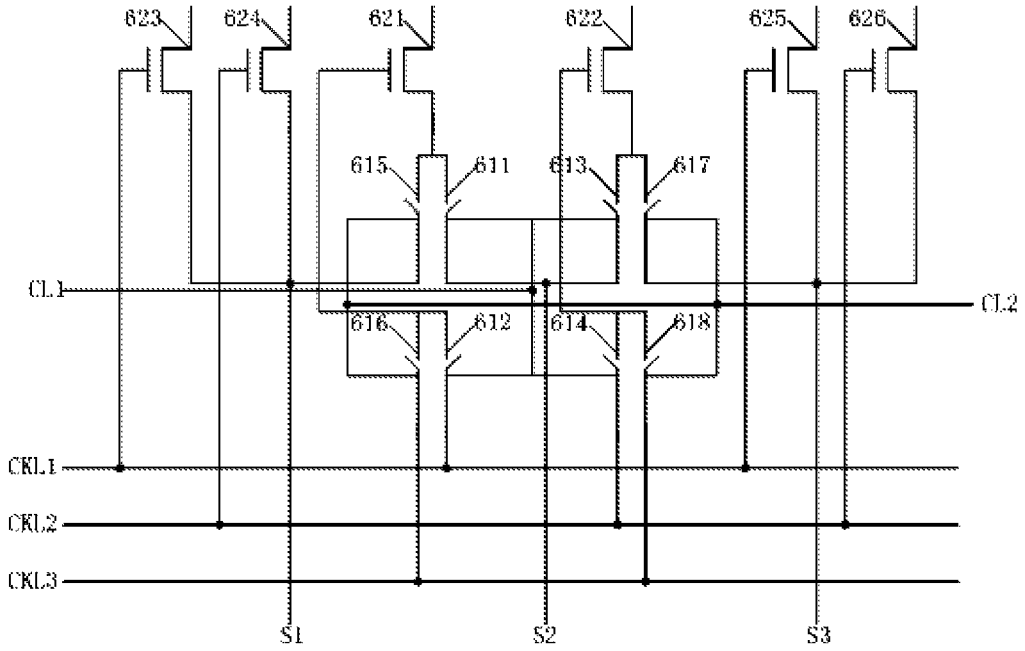
FIG. 4B is a schematic diagram of a multipath selection circuit, according to embodiments of the disclosure.

FIG. 4B is a schematic diagram of a multipath selection circuit, according to embodiments of the disclosure. The difference between the multipath selection circuit as shown in FIG. 4B and the multipath selection circuit as shown in FIG. 4A is that, the control line of the multipath selection circuit as shown in FIG. 4B includes a first control line CL1 for transmitting a first control signal and a second control line CL2 for transmitting a second control signal. In the multipath selection circuit as shown in FIG. 4B, the first control line CL1 is configured to be connected with the first switch and the second control line CL2 is configured to be connected with the second switch.

In the case that the level of the first control signal is inverse to the level of the second control signal in terms of high and low levels, the sub-switches of both the first switch and the second switch are configured as P-type transistors, and hence when the first switch is turned on, the second switch is turned off; or, the sub-switches of both the first switch and the second switch are configured as N-type transistors, and hence when the first switch is turned off, the second switch is turned on; or, the sub-switches of the first switch are configured as P-type transistors and the sub-switches of the second switch are configured as N-type transistors, and also a gate electrode of the N-type transistor is connected with the output terminal of the inverter, and the input terminal of the inverter is connected with the second control line CL2, and hence when the first switch is turned on, the second switch is turned off; or, the sub-switches of the first switch are configured as N-type transistors and the sub-switches of the second switch are configured as P-type transistors, and also a gate electrode of the P-type transistor is connected with the output terminal of the inverter and the input terminal of the inverter is connected with the second control line CL2, and hence when the first switch is turned on, the second switch is turned off.

In the case that the first control signal is the same with the second control signal, the sub-switches of the first switch are configured as P-type transistors and the sub-switches of the second switch are configured as N-type transistors; or, the sub-switches of the first switch are configured as N-type transistors and the sub-switches of the second switch are configured as P-type transistors; or, the sub-switches of the first switch are P-type transistors and the sub-switches of the second switch are P-type transistors, and also the gate electrodes of the P-type transistors of the second switch are further connected with the output terminal of the inverter, and the input terminal of the inverter is connected with the second control line CL2; or, the sub-switches of the first switch are configured as N-type transistors and the sub-switches of the second switch are configured as N-type transistors, and also the gate electrodes of the N-type transistors of the second switch are further connected with the output terminal of the inverter, and the input terminal of the inverter is connected with the second control line CL2. The gate electrodes of the four sub-switches of the first switch receive the first control signal, and the gate electrode of the four sub-switches of the second switch receive the second control signal; when the first switch is turned on, the second switch is turned off; when the second switch is turned on, the first switch is turned off, so that the multipath selection circuit achieves the data selection function and the above-mentioned two operating modes.

Figure 5A:
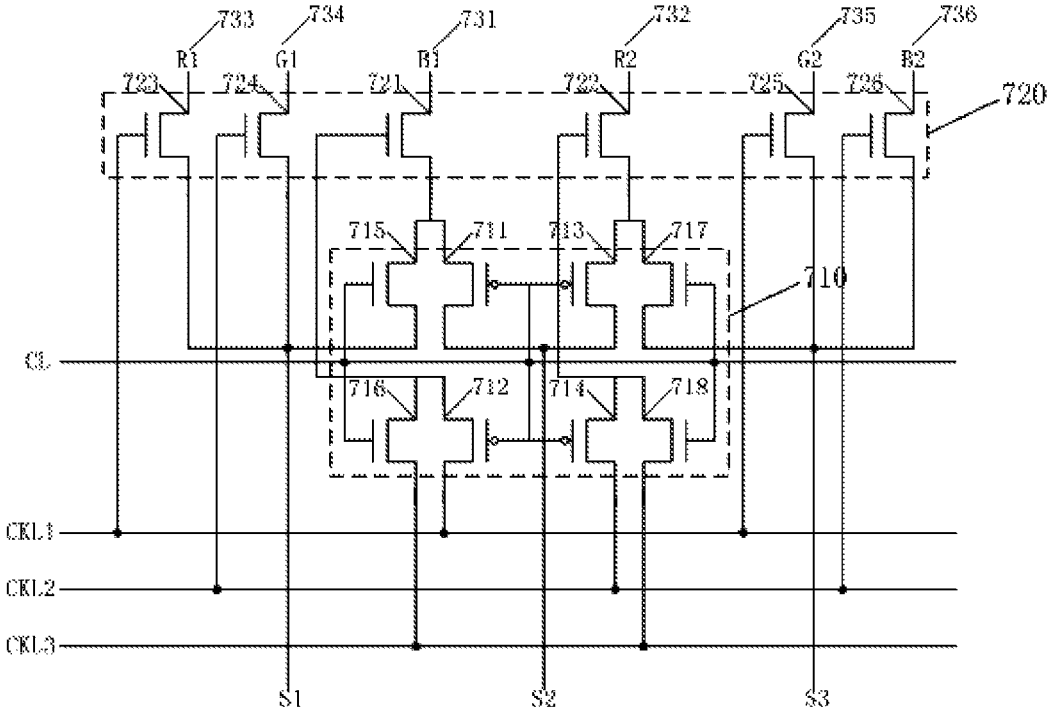
FIG. 5A is a schematic diagram of a display device, according to embodiments of the disclosure.

FIG. 5A is a schematic diagram of a display device, according to embodiments of the disclosure. The display device includes: the multipath selection circuit as described above and further includes six pixels; the multipath selection circuit includes a switch circuit 710, a driving circuit 720, a control line CL for transmitting a control signal, a first timing line CKL1 for transmitting a first timing signal CKH1, a second timing line CKL2 for transmitting a second timing signal CKH2, a third timing line CKL3 for transmitting a third timing signal CKH3, a first data line S1 for transmitting a first data signal, a second data line S2 for transmitting a second data signal, a third data line S3 for transmitting a third data signal, where, a first switch of the switch circuit 710 includes a first P-type transistor 711, a second P-type transistor 712, a third P-type transistor 713, and a fourth P-type transistor 714, and a second switch of the switch circuit 710 includes a first N-type transistor 715, a second N-type transistor 716, a third N-type transistor 717, and a fourth N-type transistor 718.

The six pixels includes: a first pixel 731 connected with a drain electrode of the first switching transistor 721, a second pixel 732 connected with a drain electrode of the second switching transistor 722, a third pixel 733 connected with a drain electrode of the third switching transistor 723, a fourth pixel 734 connected with a drain electrode of the fourth switching transistor 724, a fifth pixel 735 connected with a drain electrode of the fifth switching transistor 725, and a sixth pixel 736 connected with a drain electrode of the sixth switching transistor 726.

The multipath selection circuit switches the display device into the 1:3 operating mode or the 1:2 operating mode.

As described above, referring to the timing diagram shown in FIG. 2C, to operate the multipath selection circuit in the 1:3 operating mode, a control signal, i.e. a control signal having a high level, should be inputted to turn on the second switch; since the second switch is turned on, the first switch is turned off; in a clock cycle, the display device receives a first timing signal CKH1, a second timing signal CKH2 and a third timing signal CKH3 outputted from a first timing line CKL1, a second timing line CKL2 and a third timing line CKL3, respectively, and the display by the display device is described as follow: during the time period t1, the first timing signal CKH1 is at a high level, and the first data line S1 transmits the first data signal to a source electrode of the third switching transistor 723 to enable the third pixel 733 to emit light; during the time period t2, the second timing signal CKH2 is at a high level, and the first data line S1 transmits the first data signal to a source electrode of the fourth switching transistor 724 to enable the fourth pixel 734 to emit light; during the time period t3, the third timing signal CKH3 is at a high level, and the first data line S1 transmits the first data signal to a source electrode of the first switching transistor 721 via the first N-type transistor 715 to enable the first pixel 731 to emit light; during the time period t4, the third timing signal CKH3 is at a high level, and the third data line S3 transmits the third data signal to a source electrode of the second switching transistor 722 via the third N-type transistor 717 to enable the second pixel 732 to emit light; during the time period t5, the first timing signal CKH1 is at a high level, and the third data line S3 transmits the third data signal to a source electrode of the fifth switching transistor 725 to enable the fifth pixel 735 to emit light; and during the time period t6, the second timing signal CKH2 is at a high level, and the third data line S3 transmits the third data signal to a source electrode of the sixth switching transistor 726 to enable the eighth pixel 736 to emit light.

As such, in a clock cycle including time periods t1 to t6, an input data line of the display device controls three pixels in a time division manner, and six pixels are enabled for displaying during different time periods of the clock cycle in a time division manner. The input data line of the display device specifically refers to an IC signal line, and as for each of the six pixels, a column of pixels including the pixel are all connected with the IC signal line, and thus, in the 1:3 operating mode, each of the two IC signal lines (i.e, the first data line and the third data line) of the display device controls three columns of pixels.

Referring to the timing diagram shown in FIG. 2D, to operate the multipath selection circuit in the 1:2 operating mode, a control signal, i.e. a control signal having a low level, should be inputted to turn on the first switch; since the first switch is turned on, and the second switch is turned off; in this case, in a clock cycle, the display device receives a first timing signal CKH1 and a second timing signal CKH2 and hence the display by the display device is described as follow: during the time period t1, the first timing signal CKH1 is at a high level, and the first data line S1 transmits the first data signal to a source electrode of the third switching transistor 723 to enable the third pixel 733 to emit light; during the time period t2, the second timing signal CKH2 is at a high level, and the first data line S1 transmits the first data signal to a source electrode of the fourth switching transistor 724 to enable the fourth pixel 734 to emit light; during the time period t3, the first timing signal CKH1 is at a high level, and the second data line S2 transmits the second data signal to a source electrode of the first switching transistor 721 via the first P-type transistor 711 to enable the first pixel 731 to emit light; during the time period t4, the second timing signal CKH2 is at a high level, and the second data line S2 transmits the second data signal to a source electrode of the second switching transistor 722 via the third P-type transistor 713 to enable the second pixel 732 to emit light; during the time period t5, the first timing signal CKH1 is at a high level, and the third data line S3 transmits the third data signal to a source electrode of the fifth switching transistor 725 to enable the fifth pixel 735 to emit light; and during the time period t6, the second timing signal CKH2 is at a high level, and the third data line S3 transmits the third data signal to a source electrode of the sixth switching transistor 726 to enable the eighth pixel 736 to emit light.

As such, in a clock cycle including time periods t1 to t6, an input data line of the display device controls two pixels in a time division manner, and six pixels are enabled for displaying during different time periods of the clock cycle in a time division manner, and thus an IC signal line of the display device controls two columns of pixels.

Optionally, the first pixel 731 can be constructed by the column of sub-pixels B1, the second pixel 732 can be constructed by the column of sub-pixels R2, the third pixel 733 can be constructed by the column of sub-pixels R1, the fourth pixel 734 can be constructed by the column of sub-pixels G1, the fifth pixel 735 can be constructed by the column of sub-pixels G2 and the sixth pixel 736 can be constructed by the column of sub-pixels B2, on the display device.

Figure 5B:
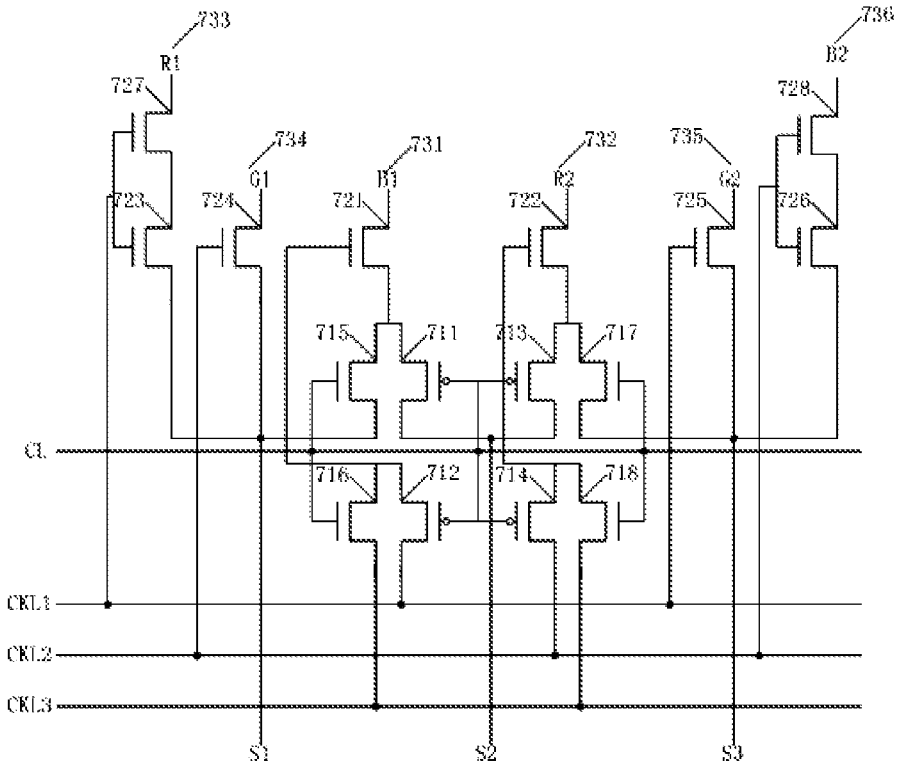
FIG. 5B is a schematic diagram of another display device, according to embodiments of the disclosure.

FIG. 5B is a schematic diagram of another display device, according to embodiments of the disclosure. For example, the multipath selection circuit of the display device operates in the 1:3 operating mode.

When the first data signal outputted from the first timing line S1 is transmitted to the third pixel 733 (R1), the first data signal is transmitted via a switching transistor, i.e. the third switching transistor 723; when the third data signal outputted from the third timing line S3 is transmitted to the second pixel 732 (R2), the third data signal is transmitted via a transistor of the switch circuit and further transmitted via the second switching transistor 722; since resistance of the transistor is large and the third pixel 733 (R1) and the second pixel 732 (R2) correspond to different columns of pixels R, unequal loads of different data lines connected with pixels R from different columns would be induced, thereby possibly leading to some defects such as spots and ripple in the different columns of pixels R, i.e. Mura. Similarly, when the first data line S1 transmits the data signal to the first pixel 731 (B1) and the third data line S3 transmits the data signal to the sixth pixel 736 (B2), Mura risks may also occur in two columns of pixels B. Similarly, when the display device is operating in the 1:2 operating mode, Mura risks may also occur. In view of this, a transistor can be added in a pixel in order to avoid the Mura risks in the pixel.

Optionally, a first driving transistor 727 is further provided between the third pixel 733 R1 and the third switching transistor 723, a gate electrode of the third switching transistor 723 is connected with a gate electrode of the first driving transistor 727, a drain electrode of the third switching transistor 723 is connected with a source electrode of the first driving transistor 727, and a drain electrode of the first driving transistor 727 is connected with the third pixel 733. It is noted that, the gate electrode of the third switching transistor 723 is connected with the gate electrode of the first driving transistor 727 and further connected with the first timing line CKL1, so that the first data signal passes through a switching transistor and a driving transistor before the first data signal is transmitted to the third pixel 733 R1, and the third data signal passes through two transistors before the third data signal is transmitted to the second pixel 732 R2, so as to avoid Mura risks of different columns of pixels R in the display device.

A second driving transistor 728 is further provided between the sixth pixel 736 B2 and the sixth switching transistor 726, a gate electrode of the sixth switching transistor 726 is connected with a gate electrode of the second driving transistor 728, a drain electrode of the sixth switching transistor 726 is connected with a source electrode of the second driving transistor 728, and a drain electrode of the second driving transistor 728 is connected with the sixth pixel 736. In is noted that, the gate electrode of the sixth switching transistor 726 is connected with the gate electrode of the second driving transistor 728 and further connected with the second timing line CKL2, so that the first data signal passes through two transistors before the first data signal is transmitted to the first pixel 731 B1, and the third data signal passes through a switching transistor and a driving transistor before the third data signal is transmitted to the sixth pixel 736 B2, so as to avoid Mura risks in the display device.

Figure 5C:
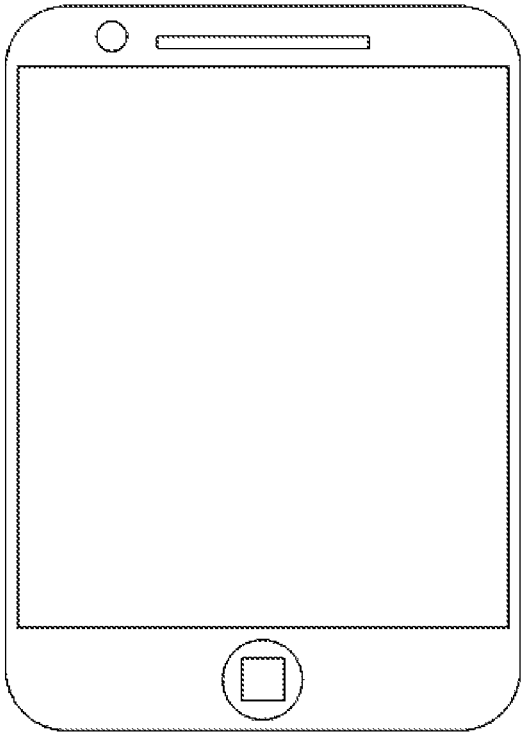
FIG. 5C is a plane schematic diagram of another display device, according to embodiments of the disclosure.

FIG. 5C is a plane schematic diagram of another display device, according to embodiments of the disclosure. The display device may be a device such as a cellphone, a tablet computer, and have stronger adaptability with respect to the data signals.

With the switch circuit provided by the present disclosure where the switch circuit can operate in the first operating mode and the second operating mode and can be switched between the first operating mode and the second operating mode, the multipath selection circuit including the switch circuit can operate in the 1:3 operating mode and the 1:2 operating mode, and can further arbitrarily switch between the 1:3 operating mode and the 1:2 operating mode. Accordingly, the display device including the multipath selection circuit can be adapted for two operating modes so as to improve adaptability of the display device with respect to the data signals.

It is noted that the embodiments and the applied technology principles of the disclosure are merely described as above. It should be understood that the disclosure is not limited to particular embodiments described herein. Various apparent changes, readjustments and alternatives can be made without departing from the scope of protection of the disclosure. Therefore, although the disclosure is illustrated in detail through the above embodiments, the disclosure is not limited to the above embodiments, and can further include more or other embodiments without departing from the concepts of the disclosure.

Various modifications and additions can be made to the exemplary embodiments discussed without departing from the scope of the disclosure. For example, while the embodiments described above refer to particular features, the scope of this disclosure also includes embodiments having different combinations of features and embodiments that do not include all of the described features. Accordingly, the scope of the disclosure is intended to embrace all such alternatives, modifications, and variations as fall within the scope of the claims, together with all equivalents thereof.

We claim:

1. A multipath selection circuit, comprising:

a first data line for transmitting a first data signal, a second data line for transmitting a second data signal, a third data line for transmitting a third data signal, a control line for transmitting a control signal, a timing line for transmitting a timing signal, a switch circuit and a drive circuit, wherein, the drive circuit comprises at least a first switching transistor and a second switching transistor;

the switch circuit is configured to receive the control signal, the timing signal, the first data signal, the second data signal and the third data signal, and operate in a first operating mode or a second operating mode according to the control signal and the timing signal;

wherein in the first operating mode, the switch circuit is configured to transmit the second data signal to the first switching transistor and the second switching transistor in a time division manner; and in the second operating mode, the switch circuit is configured to transmit the first data signal to the first switching transistor and transmit the third data signal to the second switching transistor.

2. The multipath selection circuit of claim 1, wherein, the drive circuit further comprises a third switching transistor, a fourth switching transistor, a fifth switching transistor, and a sixth switching transistor; a gate electrode of the third switching transistor, a gate electrode of the fourth switching transistor, a gate electrode of the fifth switching transistor and a gate electrode of the sixth switching transistor are configured to receive the timing signal; a source electrode of the third switching transistor and a source electrode of the fourth switching transistor are configured to receive the first data signal; and a source electrode of the fifth switching transistor and a source electrode of the sixth switching transistor are configured to receive the third data signal.

3. The multipath selection circuit of claim 2, wherein, the timing line comprises:

a first timing line for transmitting a first timing signal, a second timing line for transmitting a second timing signal, and a third timing line for transmitting a third timing signal; and the first timing line is configured to transmit the first timing signal to the gate electrode of the third switching transistor, the switch circuit, and the gate electrode of the fifth switching transistor, respectively; the second timing line is configured to transmit the second timing signal to the gate electrode of the fourth switching transistor, the switch circuit and the gate electrode of the sixth switching transistor, respectively; and the third timing line is configured to transmit the third timing signal to the switch circuit.

4. The multipath selection circuit of claim 3, wherein, the third timing line further comprises an XNOR gate; wherein, the first timing line is connected with a first input terminal of the XNOR gate, the second timing line is connected with a second input terminal of the XNOR gate, and the third timing signal is outputted from an output terminal of the XNOR gate.

5. The multipath selection circuit of claim 3, wherein:

the multipath selection circuit further comprises a third switching transistor, a fourth switching transistor, a fifth switching transistor, and a sixth switching transistor; a source electrode of the third switching transistor and a source electrode of the fourth switching transistor are configured to receive the first data signal, a gate electrode of the third switching transistor is configured to receive the first timing signal, and a gate electrode of the fourth switching transistor is configured to receive the second timing signal; and a source electrode of the fifth switching transistor and a source electrode of the sixth switching transistor are configured to receive the third data signal, a gate electrode of the fifth switching transistor is configured to receive the first timing signal, and a gate electrode of the sixth switching transistor is configured to receive the second timing signal.

6. The multipath selection circuit of claim 1, wherein, the switch circuit comprises a first switch and a second switch.

7. The multipath selection circuit of claim 6, wherein:

when the control signal received by the switch circuit enables the first switch to be turned on, the switch circuit transmits the second data signal to the first switching transistor and the second switching transistor via the first switch in a time division manner under the control of the timing signal; and when the control signal received by the switch circuit enables the second switch to be turned on, the switch circuit transmits the first data signal to the first switching transistor and transmits the third data signal to the second switching transistor, via the second switch, under the control of the timing signal.

8. The multipath selection circuit of claim 7, wherein, the first switch and the second switch are respectively connected with the control line and the timing line and are turned on or turned off under the control of the control signal and the timing signal, respectively; the first switch is further connected with the second data line to transmit the second data signal to a source electrode of the first switching transistor and a source electrode of the second switching transistor in a time division manner; and the second switch is further connected with the first data line and the third data line, to transmit the first data signal to the source electrode of the first switching transistor and transmit the third data signal to the source electrode of the second switching transistor.

9. The multipath selection circuit of claim 8, wherein:

the first switch comprises: a first P-type transistor, a second P-type transistor, a third P-type transistor, and a fourth P-type transistor, and the second switch comprises: a first N-type transistor, a second N-type transistor, a third N-type transistor, and a fourth N-type transistor; or, the first switch comprises: a first N-type transistor, a second N-type transistor, a third N-type transistor, and a fourth N-type transistor, and the second switch comprises: a first P-type transistor, a second P-type transistor, a third P-type transistor, and a fourth P-type transistor; and gate electrodes of the four transistors of the first switch are configured to receive the control signal, and gate electrodes of the four transistors of the second switch are configured to receive the control signal.

10. The multipath selection circuit of claim 9, wherein:

the switch circuit is configured such that a drain electrode of the first N-type transistor and a source electrode of the first P-type transistor are connected to the source electrode of the first switching transistor, a drain electrode of the second N-type transistor and a source electrode of the second P-type transistor are connected to the gate electrode of the first switching transistor, a drain electrode of the third N-type transistor and a source electrode of the third P-type transistor are connected to the source electrode of the second switching transistor, and a drain electrode of the fourth N-type transistor and a source electrode of the fourth P-type transistor are connected to the gate electrode of the second switching transistor;

a source electrode of the second N-type transistor, a drain electrode of the second P-type transistor, a source electrode of the fourth N-type transistor and a drain electrode of the fourth P-type transistor are configured to receive the timing signal;

if the first switch comprises four P-type transistors and the second switch comprises four N-type transistors, a source electrode of the first N-type transistor is configured to receive the first data signal, a drain electrode of the first P-type transistor and a drain electrode of third P-type transistor are configured to receive the second data signal, and a source electrode of the third N-type transistor is configured to receive the third data signal; and if the first switch comprises four N-type transistors and the second switch comprises four P-type transistors, a drain electrode of the first P-type transistor is configured to receive the first data signal, a source electrode of the first N-type transistor and a source electrode of third N-type transistor are configured to receive the second data signal, and a drain electrode of the third P-type transistor is configured to receive the third data signal.

11. The multipath selection circuit of claim 8, wherein:

the first switch comprises: a first P-type transistor, a second P-type transistor, a third P-type transistor, and a fourth P-type transistor, the second switch comprises: a fifth P-type transistor, a sixth P-type transistor, a seventh P-type transistor, an eighth P-type transistor and a first inverter connected to a gate electrode of the fifth P-type transistor, a gate electrode of the sixth P-type transistor, a gate electrode of the seventh P-type transistor and a gate electrode of the eighth P-type transistor, and when the control signal received by the first inverter is at a high level, the second switch is turned on; or, the first switch comprises: a first N-type transistor, a second N-type transistor, a third N-type transistor, and a fourth N-type transistor, the second switch comprises: a fifth N-type transistor, a sixth N-type transistor, a seventh N-type transistor, an eighth N-type transistor and a second inverter connected to a gate electrode of the fifth N-type transistor, a gate electrode of the sixth N-type transistor, a gate electrode of the seventh N-type transistor and a gate electrode of the eighth N-type transistor, and when the control signal received by the second inverter is at a low level, the second switch is turned on.

12. The multipath selection circuit of claim 8, wherein:

the control line comprises: a first control line for transmitting a first control signal and a second control line for transmitting a second control signal; and the first control signal is configured to control the first switch to be turned on and turned off, and the second control signal is configured to control the second switch to be turned on and turned off.

13. The multipath selection circuit of claim 12, wherein, the first switch is configured to receive the first control signal, the second switch is configured to receive the second control signal; or, the first switch is configured to receive the second control signal, the first switch is configured to receive the first control signal.

14. A display device, comprising the multipath selection circuit of claim 1 and six pixels;

wherein, the six pixels comprise: a first pixel connected with a drain electrode of the first switching transistor, a second pixel connected with a drain electrode of the second switching transistor, a third pixel connected with a drain electrode of the third switching transistor, a fourth pixel connected with a drain electrode of the fourth switching transistor, a fifth pixel connected with a drain electrode of the fifth switching transistor, and a sixth pixel connected with a drain electrode of the sixth switching transistor.

15. The display device of claim 14, wherein, the multipath selection circuit is configured to switch the display device into a 1:3 operating mode or a 1:2 operating mode.

16. The display device of claim 14, wherein:

a first driving transistor is further connected between the third pixel and the third switching transistor, a gate electrode of the third switching transistor is connected with a gate electrode of the first driving transistor, a drain electrode of the third switching transistor is connected with a source electrode of the first driving transistor, and a drain electrode of the first driving transistor is connected with the third pixel; and a second driving transistor is further provided between the sixth pixel and the sixth switching transistor, a gate electrode of the sixth switching transistor is connected with a gate electrode of the second driving transistor, a drain electrode of the sixth switching transistor is connected with a source electrode of the second driving transistor, and a drain electrode of the second driving transistor is connected with the sixth pixel.

17. A multipath selection circuit, comprising:

a first switch and a second switch, wherein, the first switch comprises a first sub-switch, a second sub-switch, a third sub-switch, and a fourth sub-switch, and the second switch comprises a fifth sub-switch, a sixth sub-switch, a seventh sub-switch and an eighth sub-switch;

the multipath selection circuit further comprises a first switching transistor, a second switching transistor, a first data line for transmitting a first data signal, a second data line for transmitting a second data signal, a third data line for transmitting a third data signal, a first timing line for transmitting a first timing signal, a second timing line for transmitting a second timing signal and a third timing line for transmitting a third timing signal;

a source electrode of the first switching transistor is configured to receive the second data signal via the first sub-switch and receive the first data signal via the fifth sub-switch, and a gate electrode of the first switching transistor is configured to receive the first timing signal via the second sub-switch and receive the third timing signal via the sixth sub-switch;

a source electrode of the second switching transistor is configured to receive the second data signal via the third sub-switch and receive the third data signal via the seventh sub-switch, and a gate electrode of the second switching transistor is configured to receive the second timing signal via the fourth sub-switch and receive the third timing signal via the eighth sub-switch; and the four sub-switches of the first switch are configured to be turned on or turned off simultaneously, and the four sub-switches of the second switch are configured to be turned on or turned off simultaneously; when the first switch is turned on, the second switch is turned off, and when the first switch is turned off, the second switch is turned on.

18. The multipath selection circuit of claim 17, wherein:

the multipath selection circuit further comprises a control line for transmitting a control signal; the four sub-switches of the first switch are P-type transistors, and the four sub-switches of the second switch are N-type transistors; or, the four sub-switches of the first switch are N-type transistors, and the four sub-switches of the second switch are P-type transistors; and a gate electrode of the P-type transistor and a gate electrode of the N-type transistor are connected with the control line to receive the control signal; when the control signal is at a high level, the N-type transistor is turned on, and the P-type transistor is turned off, and when the control signal is at a low level, the N-type transistor is turned off, and the P-type transistor is turned on.

19. The multipath selection circuit of claim 17, wherein:

the multipath selection circuit further comprises a first control line for transmitting a first control signal and a second control line for transmitting a second control signal, and a level of the first control signal is inverse to a level of the second control signal in terms of high and low levels;

the sub-switches of both the first switch and the second switch are P-type transistors; or the sub-switches of both the first switch and the second switch are N-type transistors; and gate electrodes of the four sub-switches of the first switch are configured to receive the first control signal, and gate electrodes of the four sub-switches of the second switch are configured to receive the second control signal.

* * * * *